US007119826B2

(12) United States Patent
Nojima et al.

(10) Patent No.: US 7,119,826 B2
(45) Date of Patent: Oct. 10, 2006

(54) ORANIC EL ARRAY EXPOSURE HEAD, IMAGING SYSTEM INCORPORATING THE SAME, AND ARRAY-FORM EXPOSURE HEAD FABRICATION PROCESS

(75) Inventors: Shigeo Nojima, Nagano-Ken (JP); Masatoshi Yonekubo, Nagano-Ken (JP); Yujiro Nomura, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 271 days.

(21) Appl. No.: 10/736,235

(22) Filed: Dec. 16, 2003

(65) Prior Publication Data

US 2004/0233271 A1 Nov. 25, 2004

(30) Foreign Application Priority Data

Dec. 16, 2002 (JP) ..... 2002-363748
Dec. 16, 2002 (JP) ..... 2002-363749
Dec. 27, 2002 (JP) ..... 2002-381023

(51) Int. Cl.
*B41J 27/00* (2006.01)

(52) U.S. Cl. ..... 347/244; 347/258

(58) Field of Classification Search ..... 347/130, 347/237, 241–245, 256–258; 362/612–619; 359/19; 385/33, 35
See application file for complete search history.

(56) References Cited

U.S. PATENT DOCUMENTS 5,337,074 A * 8/1994 Thornton ..... 347/237

FOREIGN PATENT DOCUMENTS

| | | | |
|---|---|---|---|
| JP | 58039080 A | * | 3/1983 |
| JP | 01146389 A | * | 6/1989 |
| JP | 10-12377 A | | 1/1998 |
| JP | 10-55890 A | | 2/1998 |
| JP | 11-198433 A | | 7/1999 |
| JP | 2000-77188 A | | 3/2000 |
| JP | 2000-323276 A | | 11/2000 |
| JP | 2000-353594 A | | 12/2000 |
| JP | 2001-18441 A | | 1/2001 |
| JP | 2001121746 A | * | 5/2001 |

* cited by examiner

*Primary Examiner*—Hai Pham
(74) *Attorney, Agent, or Firm*—Sughrue Mion, PLLC

(57) ABSTRACT

The invention relates to a small-format exposure head wherein ball lenses are positioned in alignment with individual devices of an organic EL array to efficiently collect a light beam from each device onto an image carrier such as a photosensitive material with no crosstalk yet with sufficient resolving power, and an imaging system incorporating the same. An array of organic EL devices is provided on a long length of substrate 3 in at least one row of pixel arrangement. On the light-emitting side of the array of organic EL devices, a ball lens 10 is positioned in alignment and contact with each light emitter 2 of the organic EL device. The ball lens 10 formed of a transparent material having a refractive index of 2 or greater.

9 Claims, 20 Drawing Sheets

θ : Angle of propagation

L : Point of incidence
(the lowermost point)

O : Center of the ball lens

ORANIC EL ARRAY EXPOSURE HEAD, IMAGING SYSTEM INCORPORATING THE SAME, AND ARRAY-FORM EXPOSURE HEAD FABRICATION PROCESS

BACKGROUND OF THE INVENTION

The present invention relates generally to an organic electroluminescent (EL) array exposure head and an imaging system incorporating the same, and more particularly to an organic EL array exposure head adapted to make efficient use of light emitted out of each device of an organic EL array and an imaging system using the same.

The present invention is also concerned with an array-form exposure head fabrication process, especially a process for the fabrication of an organic EL array exposure head, etc. used on an imaging system.

So far, various organic EL array arrangements have been proposed for exposure heads for imaging systems. Pertinent prior arts are given below.

Patent publication 1 proposes that an organic EL array prepared on a glass or other insulating substrate in a batch fashion is combined with a separate driver IC wherein the images of light emitters of the organic EL array are formed on a photosensitive drum by means of a collective rod lens array.

Patent publication 2 proposes the use of a one-chip organic EL array comprising a plurality of rows but discloses nothing about the optical system for forming the images of light emitters on a photosensitive drum. The publication discloses that the EL layer in the organic EL array is deposited by evaporation.

Patent publication 3 teaches that microlenses are formed on the upper surface of a substrate by means of ion exchange or microlenses are prepared by a method wherein a photoresist is applied on the back surface of a substrate or a replica method and an organic EL array comprising resonator structures in alignment with such microlenses is deposited by evaporation.

Patent publication 4 relates to a process for the fabrication of an active matrix type organic display, showing that an organic light-emitting layer is formed on a glass substrate having a thin-film transistor by means of ink jetting.

Patent publication 5 teaches that the hole-injecting layer and organic light-emitting layer of an organic EL device are formed with a bank by means of ink jetting.

Patent publication 6 proposes a printer comprising a photosensitive drum in which a light-emitting layer is provided along with a TFT layer for control of light emission thereof.

Various proposals have also been made with a view to using other arrays such as LED arrays or liquid crystal shutter arrays as exposure heads for imaging systems. In most cases, reliance is on a collective rod lens array for collecting a light beam from the emitter of an LED array or the shutter of a liquid crystal shutter array onto a photosensitive drum.

Patent Publication 1
JP-A 10-55890
Patent Publication 2
JP-A 11-198433
Patent Publication 3
JP-A 2000-77188
Patent Publication 4
JP-A 10-12377
Patent Publication 5
JP-A 2000-323276

Patent Publication 6
JP-A 2001-18441
Patent Publication 7
JP-A 2000-353594
Non-Patent Publication 1
"Polymer Type Organic EL Display", The 8th Electronic Display Forum (Apr. 18, 2001)
Non-Patent Publication 2
"Fine Imaging and Hardcopy", edited by the Photography Society of Japan, the Joint Publication Committee of the Image Society of Japan, Corona Publisher Co., Ltd., Jan. 7, 1999, page 43

In the above prior art wherein an organic EL array is used on the exposure head of an electrophotographic type printer, the use of a collective rod lens array for collecting a light beam from the emitter of an organic EL device in the organic EL array onto a photosensitive drum incurs an increase in the length of an optical path, resulting in an increase of the size of the arrangement. The use of the collective rod lens, because of being not located in one-to-one relation to each emitter, gives rise a periodical variation in the quantity of light. In addition, the collective rod lens is unavoidably expensive because high techniques are needed for its fabrication. A problem with microlenses is that crosstalk is likely to occur as a result of light that emerges from a specific emitter but is incident on an unassociated pixel position via a microlens adjacent thereto, not via the associated microlens, leading to a resolving power drop.

In an arrangement wherein substrates are applied to individual microlenses one by one, some problems arise with the mechanical strength required for maintenance operations such as that for removal for toner deposited to an optical system.

On the other hand, high-refractive-index ball lenses used for reflective paints, etc. available for enhancing the visibility of traffic signs at nighttime are very expensive, and so are expected to provide an optical system at very low costs if they can be used for array-form exposure heads such as organic EL array heads.

SUMMARY OF THE INVENTION

In view of such problems with the prior art as mentioned above, one object of the invention is to provide a small-format exposure head comprising ball lenses located in alignment with individual devices of an organic EL array so that a light beam from each device can be efficiently collected onto an image carrier such as a photosensitive member with no crosstalk yet with sufficient resolving power, and an imaging system incorporating the same.

Another object of the invention is to provide a small-format exposure head comprising ball lenses firmly fixed in alignment with individual devices of an organic EL array so that a light beam from each device can be efficiently collected onto an image carrier such as a photosensitive member with no crosstalk yet with sufficient resolving power and sufficient mechanical strength is ensured for maintenance operations, and an imaging system incorporating the same.

Yet another object of the invention is to provide an organic EL array exposure head comprising ball lenses located in alignment with individual devices of an organic EL array, wherein possible poor exposure due to fouling by toner is prevented.

A further object of the invention is to provide a process for the fabrication of an array-form exposure head comprising ball lenses fixed in alignment with individual devices of array-form light sources in an organic EL array, an LED array or the like, so that a light beam from each device can be efficiently collected onto an image carrier such as a photosensitive member with no crosstalk yet with sufficient resolving power.

According to the first aspect of the invention, the above objects are achievable by the provision of an organic electroluminescent array exposure head, comprising a long length of substrate, an array of organic electroluminescent devices arranged on said substrate in at least one row of pixel pattern, and a ball lens positioned in alignment with a light emitter of each organic electroluminescent device on the light-emitting side of said array of organic electroluminescent devices, characterized in that:

said ball lens is located in such a way as to satisfy condition (8):

$$0 \leqq D \leqq 0.07 \text{ m} \quad (8)$$

where D is the distance between the surface of a light-emitting layer in the light emitter of each organic electroluminescent device and the apex of the entrance side-surface of the ball lens positioned in alignment with said light emitter, and m is the diameter of the ball lens.

Preferably in this case, the ball lens is formed of a transparent material having a refractive index of 2 or greater.

According to the second aspect of the invention, there is provided an organic electroluminescent array exposure head, comprising a long length of substrate, an array of organic electroluminescent devices arranged on said substrate in at least one row of pixel pattern, and a ball lens positioned in alignment with a light emitter of each organic electroluminescent device on the light-emitting side of the array of organic electroluminescent devices while said ball lens is in contact with said light emitter, characterized in that said ball lens is formed of a transparent material having a refractive index of 2 or greater.

Preferably, the arrangement according to the first or second aspect of the invention comprises an array of a plurality of rows of organic electroluminescent devices parallel with one another, wherein a light emitter of each organic electroluminescent device in one row is displaced from a light emitter of each organic electroluminescent device in another row by 1/number of rows with respect to a spacing between adjacent light emitters in a row.

The above arrangement may further comprise at least two array sets in a columnar direction, wherein each array set comprises a plurality of rows of organic electroluminescent devices.

Preferably in this arrangement, a light absorber is filled between adjacent ball lenses an area except an effective exit surface.

According to the third aspect of the invention, there is provided an organic electroluminescent array exposure head, comprising a long length of substrate, an array of organic electroluminescent devices arranged on said substrate in at least one row of pixel pattern, and a ball lens positioned in alignment with a light emitter of each organic electroluminescent device on the light-emitting side of the array of organic electroluminescent devices, characterized in that:

a space between adjacent ball lenses is filled with a fixing layer up to a height $m(1-1/n^2)$ as measured from the apex of the entrance side-surface of said ball lens, wherein m is the diameter of said ball lens and n is the refractive index of said ball lens, so that said ball lens is fixed in place.

Preferably in this case, that fixing layer comprises a layer capable of absorbing light.

According to the fourth aspect of the invention, there is provided an organic electroluminescent array exposure head, comprising a long length of substrate, an array of organic electroluminescent devices arranged on said substrate in at least one row of pixel pattern, and a ball lens positioned in alignment with a light emitter of each organic electroluminescent device on the light-emitting side of the array of organic electroluminescent devices, characterized in that:

said ball lens is at least embedded in an aerogel layer from a height $m(1-1/n^2)$ as measured from the apex of the entrance side-surface of said ball lens, where m is the diameter of said ball lens and n is the refractive index of said ball lens, up to a height at which the exit side-surface of said ball lens is overall covered with said aerogel layer.

Preferably in this case, a transparent protective layer is provided on the surface of said aerogel layer, and the transparent protective layer comprises a transparent conductive layer.

A fixing layer capable of absorbing light may further be provided on a substrate side of said aerogel layer.

In the organic electroluminescent array exposure head according to the third or fourth aspect of the invention, it is preferable that the ball lens has a refractive index of 2 or greater.

The present invention also includes an imaging system that incorporates any one of such organic electroluminescent array exposure heads as recited above as an exposure head for writing an image to an image carrier. A typical imaging system of the invention is a tandem type color imaging system comprising at least two imaging stations, each comprising around the image carrier a charger means, an exposure head, a toner developer means and a transfer means, wherein color imaging is carried out by passing a transfer medium through each station.

The first organic EL array exposure head of the invention comprises a long length of substrate, an array of organic electroluminescent devices arranged on said substrate in at least one row of pixel pattern, and a ball lens positioned in alignment with a light emitter of each organic electroluminescent device on the light-emitting side of said array of organic electroluminescent devices, wherein said ball lens is located in such a way as to satisfy condition (8):

$$0 \leqq D \leqq 0.07 \text{ m} \quad (8)$$

where D is the distance between the surface of a light-emitting layer in the light emitter of each organic electroluminescent device and the apex of the entrance side-surface of the ball lens positioned in alignment with said light emitter, and m is the diameter of the ball lens. Thus, nearly all diverging light leaving the light emitter of each organic EL device can be entered in the ball lens so that it can be utilized for pixel formation by projection; images of sufficient resolving power, brightness and contrast can be obtained at low power consumption yet with little or no crosstalk between adjacent pixels.

The third organic EL array exposure head of the invention comprises a long length of substrate, an array of organic electroluminescent devices arranged on said substrate in at least one row of pixel pattern, and a ball lens positioned in alignment with a light emitter of each organic electroluminescent device on the light-emitting side of the array of organic electroluminescent devices, wherein a space between adjacent ball lenses is filled with a fixing layer up to a height $m(1-1/n^2)$ as measured from the apex of the entrance side-surface of said ball lens, wherein m is the diameter of said ball lens and n is the refractive index of said ball lens, so that said ball lens is fixed in place. Thus, the ball lenses can be firmly fixed onto the substrate with the light emitters located thereon without cutting off a light beam that leaves the light emitter and is projected onto a given surface to form a pixel, thereby obtaining a small-format organic EL array exposure head having sufficient mechanical strength for maintenance operations. By using a layer capable of absorbing light as that fixing layer, it is further possible to achieve an organic EL array exposure head that has reduced crosstalk between adjacent pixels and can give an image of sufficient resolving power, brightness and contrast at low power consumption.

In the fourth organic EL array exposure head of the invention, the ball lens is at least embedded in an aerogel layer from a height $m(1-1/n^2)$ as measured from the apex of the entrance side-surface of said ball lens, where m is the diameter of said ball lens and n is the refractive index of said ball lens, up to a height at which the exit side-surface of said ball lens is overall covered with said aerogel layer. Thus, the ball lenses can be firmly fixed onto the substrate with the light emitters located thereon without cutting off a light beam that leaves the light emitter and is projected onto a given surface to form a pixel, thereby obtaining a small-format organic EL array exposure head having sufficient mechanical strength for maintenance operations. By providing a transparent protective layer, especially a transparent protective layer comprising a transparent conductive layer on the surface of the aerogel layer, it is possible to prevent fouling of the optical system of the organic EL array exposure head with toner or the like, which may otherwise lead to poor exposure or other defects.

To attain the aforesaid objects, the present invention further provides a process for fabricating an array-form exposure head comprising a long length of substrate, an array of light-emitting devices or secondary light sources arranged on said substrate in at least one row of pixel pattern, and a ball lens positioned in alignment with a light emitter of each light-emitting device or each secondary light source on the light-emitting side of the array of light-emitting devices or secondary light sources, characterized in that:

a ball lens alignment mold is provided with an array of ball-receiving holes in an arrangement conforming to an arrangement of light emitters of said array of light emitting devices or secondary light sources, wherein each ball-receiving hole has a diameter equal to or slightly larger than that of said ball lens, ball lenses are fitted in said ball lens-receiving holes in said ball lens alignment mold, and each ball lens on said ball lens alignment mold is brought close to each light emitter of said array of light-emitting devices or secondary light sources while in alignment therewith, whereupon each ball lens is bonded to said array of light-emitting devices or secondary light sources.

Preferably in this case, each ball lens-receiving hole in said ball lens alignment mold is provided with a ball lens suction mechanism for facilitating fitting of the ball lens in each ball lens-receiving hole and retaining the ball lens fitted in each ball lens-receiving hole until the ball lens is bonded and fixed to said array of light-emitting devices or secondary light sources.

It is desired that prior to bringing each ball lens on said ball lens alignment mold close to each light emitter of said array of light emitting devices or secondary light sources while in alignment therewith, whether or not a given ball lens is fitted in each ball lens-receiving hole in said ball lens alignment mold is inspected.

It is also desired that a light-emitting device is placed at the center of the bottom of each of said ball lens-receiving holes, and whether or not a given ball lens is fitted in each of said ball lens-receiving holes in said ball lens alignment mold is inspected from the light-quantity profile found when said light-emitting devices are all allowed to emit light.

It is further desired that prior to bringing each ball on said ball lens alignment mold close to each light emitter of said array of light-emitting devices or secondary light sources while in alignment therewith, an adhesive agent is applied on a surface of the substrate of said array of light-emitting devices or secondary light sources or portions of said ball lens opposite to said surface, whereupon each ball lens is brought close to and bonded to said array of light-emitting devices or secondary light sources.

Furthermore, it is desired that each ball lens is brought close to each light emitter of the array of light-emitting devices or secondary light sources, and after bonded to that array, a fixing layer is filled between adjacent ball lenses at an area except an effective exit surface.

For instance, an organic EL array or an LED array may be used as the above array of light-emitting devices or secondary light sources.

The present invention also includes an imaging system incorporating an array-form exposure head fabricated by the above fabrication process as an exposure head for writing an image to an image carrier. A typical imaging system of the invention is a tandem type color imaging system comprising at least two imaging stations, each comprising around the image carrier a charger means, an exposure head, a toner developer means and a transfer means, wherein color imaging is carried out by passing a transfer medium through each station.

In the above array-form exposure head fabrication process of the invention, a ball lens alignment mold is provided with an array of ball-receiving holes in an arrangement conforming to an arrangement of light emitters of said array of light emitting devices or secondary light sources, wherein each ball-receiving hole has a diameter equal to or slightly larger than that of said ball lens, ball lenses are fitted in said ball lens-receiving holes in said ball lens alignment mold, and each ball lens on said ball lens alignment mold is brought close to each light emitter of said array of light-emitting devices or secondary light sources while in alignment therewith, whereupon each ball lens is bonded to said array of light-emitting devices or secondary light sources. It is thus possible to make use of inexpensive, high-refractive-index ball lenses used for reflective paints or the like to fabricate an array-form exposure head such as an LED array exposure head at extremely low costs. In addition, it is possible to achieve an automated optical system alignment/fixation system for high-quality, low-cost array-form exposure heads, thereby fabricating high-quality, low-cost array-form exposure heads.

Further, no large impact is likely to be applied on the ball lenses upon alignment, and so the ball lenses are unlikely to chip off to ensure provision of a high-quality array-form exposure head.

Furthermore, whether alignment is acceptable or unacceptable, and whether or not ball lenses chip off can be 100% inspected at high speed and with high precisions, so that high-quality, low-cost array-form exposure heads can be provided.

Still other objects and advantages of the invention will in part be obvious and will in part be apparent from the specification.

The invention accordingly comprises the features of construction, combinations of elements, and arrangement of parts, which will be exemplified in the construction hereinafter set forth, and the scope of the invention will be indicated in the claims.

DESCRIPTION OF THE PREFERRED EMBODIMENTS

Preferred embodiments of the organic EL array exposure head according to the invention and the imaging system incorporating the same are now explained with reference to the accompanying drawings.

Figure 1:
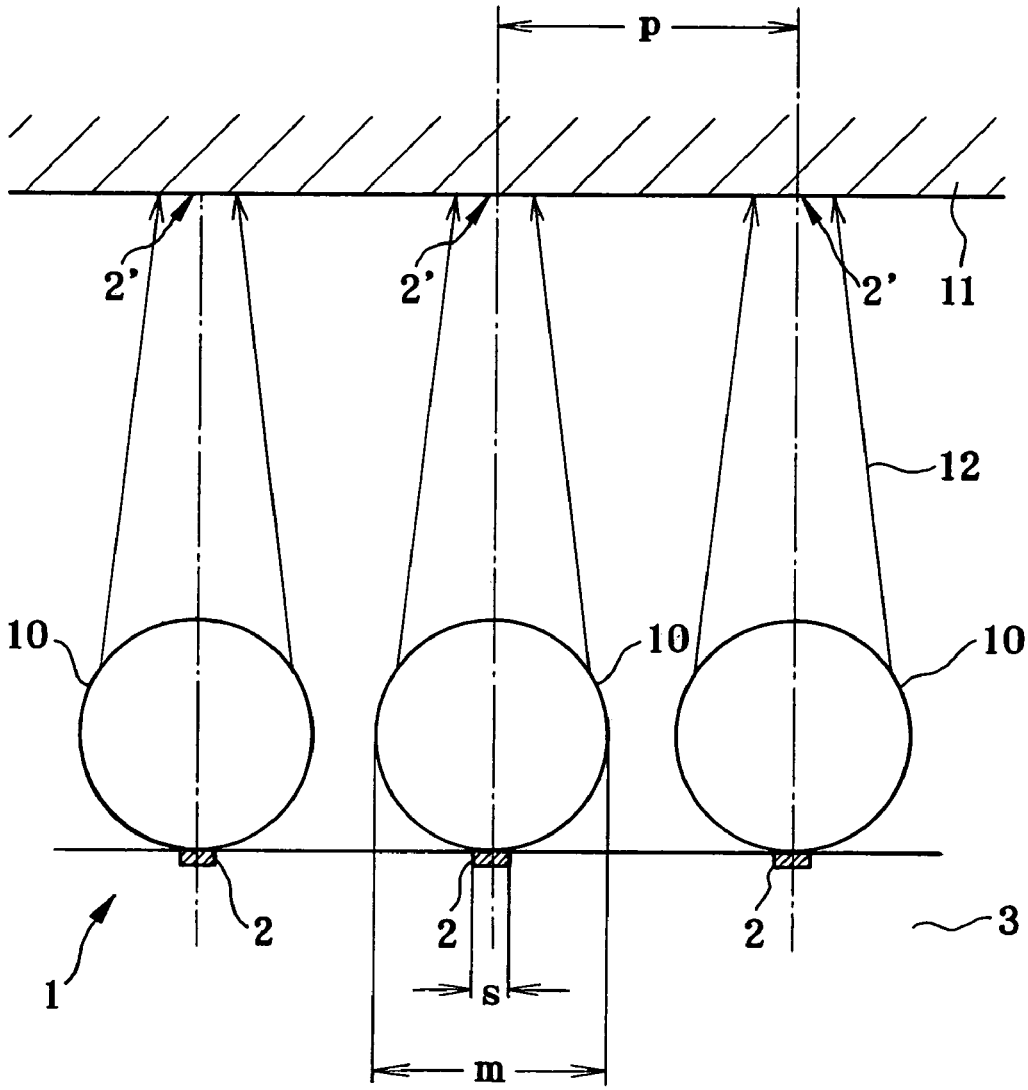
FIG. 1 is schematically illustrative in section of the basic construction of the first aspect of the organic EL array exposure head according to the invention.

FIG. 1 is schematically illustrative in section of the basic construction of the first aspect of the organic EL array exposure head according to the invention. As shown in FIG. 1, organic EL light emitters 2 are arranged on the surface of a substrate 3 at a constant period to set up an organic EL array 1. According to the invention, ball lenses 10 of the same shape and properties are positioned in one-to-one alignment relations to the associated light emitters 2 of the organic EL array 1, so that a light beam from each light emitter 2 is split through the ball lens 10 for incidence on an image carrier 11 formed of a photosensitive material (for electro-photography) or the like, which forms a member onto which an image is to be projected. It is noted that the ball lens 10 referred to above is a single positive lens formed of a transparent sphere.

Each ball 10 should be located in contact with or near to the surface of the associated light emitter 2, so that nearly all of divergent light leaving the light emitter 2 can enter the associated ball lens 10. It is here noted that if the diameter s of the light emitter 2 is much lager than the diameter m of the ball lens 10 and the ball lens 10 is in contact with the surface of the light emitter 2, almost 100% of the light can then enter the ball lens 10. Thus, it is possible to reduce cross-talk—a phenomenon wherein the light emerging from the light emitter 2 is incident on an unassociated pixel position via a ball lens 10 adjacent to the associated ball lens 10.

To allow a light beam leaving the ball lens 10 located in contact with or near to the surface of the light emitter 2 to be split as a pixel for incidence on the image carrier 11, the ball lens 10 should be formed of a transparent material having a refractive index of at least 2 with respect to light emitted out of the light emitter 2. Glass materials having a refractive index of 2 or more, for instance, include bismuth-based glasses, glasses containing much heavy metals or optical crystals.

Figure 2A:
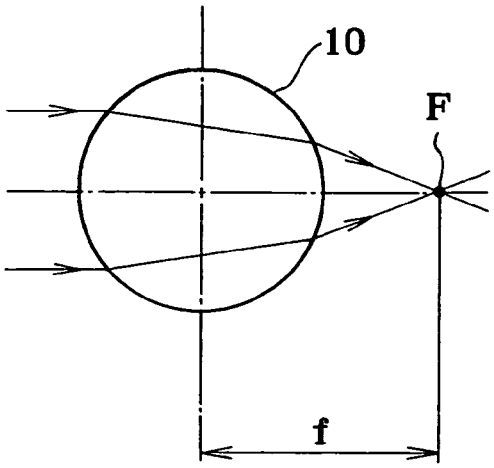
FIGS. 2(*a*) and 2(*b*) are illustrative of the properties of a ball lens.
Figure 2B:
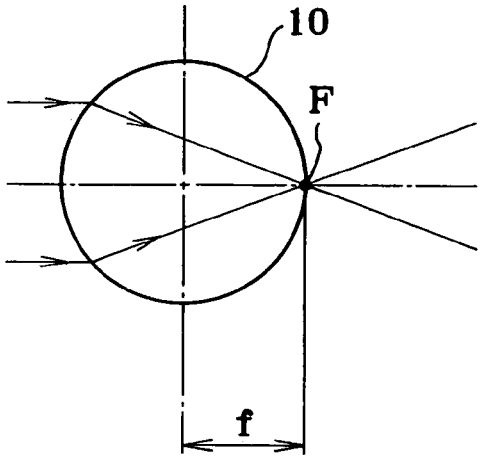

Important geometric optics characteristics of the ball lens 10 having a refractive index of 2 or more are now explained. The focal length f of the paraxial optical ball lens 10 is determined by $$f=nr/\{2(n-1)\} \quad (1)$$

with a principal point in agreement with the center of the ball lens 10. When the refractive index n is n<2, the focus F is located outside of the ball lens 10 as shown in FIG. 2(*a*). When n=2, however, the focus F is positioned on the spherical (front) surface of the ball lens 10 that spaces away from the entrance side, as shown in FIG. 2(*b*).

With the ball lens 10 of n≧2 located in contact with or near to the surface of the light emitter 2 as shown in FIG. 1, therefore, light beams 2 leaving the light emitters 2 via the ball lenses 10 are converted into split, parallel or condensed light beams for incidence on the image carrier 11, so that pixels (light emitters 2) displayed on the organic EL array 1 can be exposed to light on the image carrier 11 in one-to-one relations. Thus, the organic EL array 1 comprising ball lenses 10 positioned in contact with or near to the surfaces of light emitters 2 in one-to-one relations can be used as an exposure head.

With such reduced crosstalk as mentioned above in mind, it is desired that the ball lenses 10 be as near to the light emitters 2 of the organic EL array as possible, i.e., the distance D between the apex of the entrance side surface of each ball lens 10 and the surface of the associated light emitter 2 be D≈0. Because a transparent electrode or the like is actually present on the surface of the light emitter 2, however, the distance D will unavoidably have a certain value. To what length is acceptable for the distance D is now considered.

Figure 3:
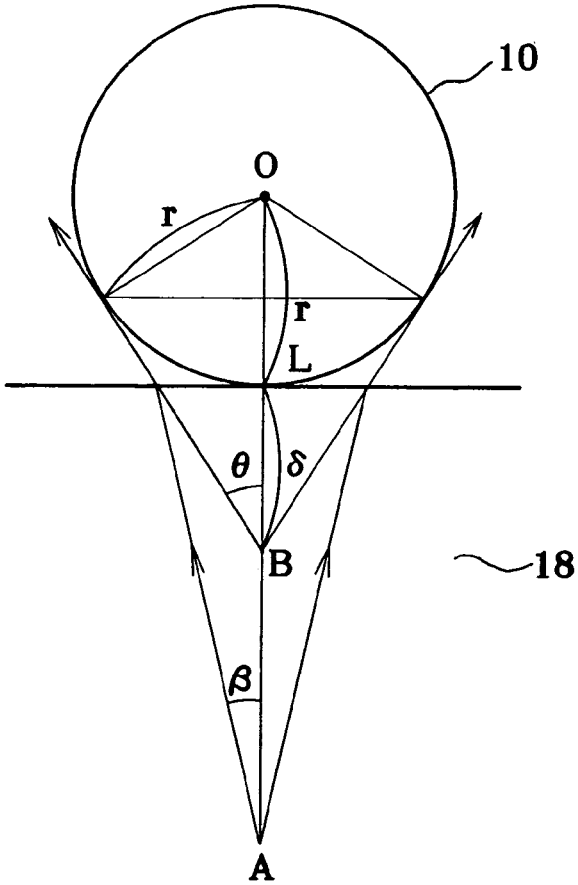
FIG. 3 is a schematic for studying the proportion of the quantity of light that can become crosstalk in the light emitted out of each light emitter of an organic EL array.

With an apparent light source B positioned at a point B spaced δ-away form a ball lens 10, as shown in FIG. 3, crosstalk could occur because light leaving the point B at an exit angle θ enters the ball lens 10 but the rest of light does not. It is here noted that at the angle θ a straight line passing through the point B and tangential to the ball lens 10 subtends an center axis that is a straight line passing through the point B and the center O of the ball lens 10.

At this time, the angle θ may be represented by $$\sin\theta = r/(r+\delta) \tag{2}$$

where r is the radius of the ball lens 10.

Suppose now that the ball lens 10 is bonded onto a substrate 18 having a refractive index n and a light source is positioned at a point A within the substrate 18. Then, crosstalk could occur because, in FIG. 3, light leaving the point A at an angle of β or smaller enters the ball lens 10 but the rest of light does not. It is here noted that the angle β is an exit angle at which light leaving the point A and refracted at the surface of the substrate 18 leaves the apparent light source B at an angle θ.

The angle β is then represented by $$\sin\beta = r/\{n(r+\delta)\} \tag{3}$$

Next, of the light emerging from the point A, the quantity of light that can be extracted out of the substrate (organic EL device) 18 is found. By virtue of the presence of a total reflection critical angle $\theta_c$ due to the refractive index of the substrate 18, light propagating from within the substrate 18 at the exit angle β toward the surface of the substrate 18 is taken out of the substrate (organic EL device) 18 provided that $\theta_c > \beta$. The emission intensity of a surface light emitter harnessing isotropic light emission such as the light emitter 2 of the organic EL device conforms to Lambert's law. Given $I(\theta) = I_0 \cos\theta$, the quantity of light radiated within the critical angle becomes $$\begin{aligned}\int I_0\cos\theta\, d\Omega &= 2\pi I_0 \int_0^{\theta_c} \cos\theta\sin\theta\, d\theta \\ &= \pi I_0 \sin^2\theta_c \\ &= \pi I_0/n^2 \quad (\because \sin\theta_c = 1)\end{aligned} \tag{4}$$

Here dΩ is a solid angle.

Of the light radiated from the point (light source) A within the critical angle $\theta_c$, the quantity of light that does not enter the ball lens 10 is given by $$\begin{aligned}2\pi I_0 \int_\beta^{\theta_c} \cos\theta\sin\theta\, d\theta &= \pi I_0 \sin 2\theta_c - \pi I_0 \sin^2\beta \\ &= \pi I_0/n^2 - (\pi I_0/n^2)\times r^2/(r+\delta)^2 \\ &= (\pi I_0/n^2)\times(2r\delta+\delta^2)/(r+\delta)^2\end{aligned} \tag{5}$$

Therefore, of the light emerging from each light emitter 2 of the organic EL array 1, the proportion of the quantity of light that could become crosstalk is represented by $$(2r\delta+\delta^2)/(r+\delta)^2 \tag{6}$$

Here, if it is acceptable that up to 5% of the emerging light become crosstalk, the following condition is obtained.

$$\delta \leqq 0.026\ r \tag{7}$$

When, at δ=0.026 r, the refractive index n of the organic EL array 1 (the refractive index of the substrate 18) is set at 1.5, the distance between the points A and L in FIG. 3 (the distance between the light emitter 2 and the ball lens 10) becomes 0.132 r=0.066 m.

From the above consideration, it is appreciated that the distance D between the surface of each light emitter 2 of the organic EL array 1 and the apex of the entrance side surface of the ball lens 10 located in line with each light emitter 2 should preferably satisfy the following relation:

$$0 \leqq D \leqq 0.07\ \text{m} \tag{8}$$

Here m is the diameter of the ball lens 10 as described above.

In the aforesaid organic EL array exposure head of the invention, the ball lenses 10 are positioned in contact with or near to the surfaces of the light emitters 2 in one-to-one relations. This will inevitably make the image-side conjugate distance (from the ball lens 10 to the image carrier 11) longer than the object-side conjugate distance; the image 2' of each light emitter 2 projected onto the image carrier 11 will be magnified. To allow the images 2' of the light emitters 2 to be mutually separated upon projection onto the image carrier 11 with the desired resolution, the dimension s of the light emitters 2 must be much smaller than the diameter m of the ball lenses 10 in such a way that the magnification can be compensated for. With the dimension s of the light emitters 2 relatively reduced while taking such relations in account, the proportion of divergent light leaving the light emitters 2 and entering the ball lenses 10 becomes so high that crosstalk can be cut off.

When it comes to an exposure head of 600 dpi as a specific example, the distance between the ball lens 10 and the image carrier 11 should be 300 μm and the desired size of one pixel (the size of the image 2') on the image carrier 11 should be □70 μm. In other words, when the ball lens 10 selected has a refractive index of n=1.5 and a diameter of m=120 μm, the size of the organic EL light emitter 2 should be □20 μm.

As can be understood from the foregoing, the diameter m of the ball lens must be increased to make the image 2' of the light emitter 2 resolvable on the surface onto which the image is to be projected (the surface of the image carrier 11) and reduce crosstalk. With the organic EL array comprising one row of light emitters 2, however, it is difficult to achieve an exposure head having the desired resolution, because the pitch p between the ball lenses 10 can be never smaller than the diameter m thereof. In this case, such an exposure head having the desired resolution can be achieved by allowing the organic EL array 1 to have a plurality of parallel rows (e.g., three rows $\mathbf{20}_1$, $\mathbf{20}_2$ and $\mathbf{20}_3$) of light emitters 2 and locating ball lenses 10 in alignment with the light emitters in three such rows $\mathbf{20}_1$, $\mathbf{20}_2$ and $\mathbf{20}_3$ and in one-to-one relations, as shown typically in FIG. 4 that is a perspective illustration as viewed from the side of the image carrier 11.

For instance, suppose now that the desired resolution is 600 dpi and the diameter of the ball lens 10 is 120 μm. Then, the resolution at a pitch given by the diameter of the ball lens 10 of 120 μm, i.e., the resolution for only the light emitters 2 in any one of the rows $\mathbf{20}_1$, $\mathbf{20}_2$ and $\mathbf{20}_3$ is 211.7 dpi. Thus, if the pitch of the light emitters 2 in any one of the rows $\mathbf{20}_1$, $\mathbf{20}_2$ and $\mathbf{20}_3$ is determined in such a way as to be smaller than 211.7 dpi, e.g., 200 dpi that is the maximum among the submultiples of 600, say, 200 (a pitch of 127 μm), the desired resolution can then be achieved by subjecting an exposure head to scanning exposure with respect the image carrier 11 in a direction indicated by a double-action arrow while the rows $\mathbf{20}_1$, $\mathbf{20}_2$ and $\mathbf{20}_3$ of the light emitters 2 are displaced by a pitch for the desired resolution (42.33 μm that is a pitch of 600 dpi) in a row direction and arranged in the number corresponding to (the desired resolution (dpi)/resolution (dpi) for one row) (e.g., three rows $\mathbf{20}_1$, $\mathbf{20}_2$ and $\mathbf{20}_3$) in a columnar direction.

Figure 4:
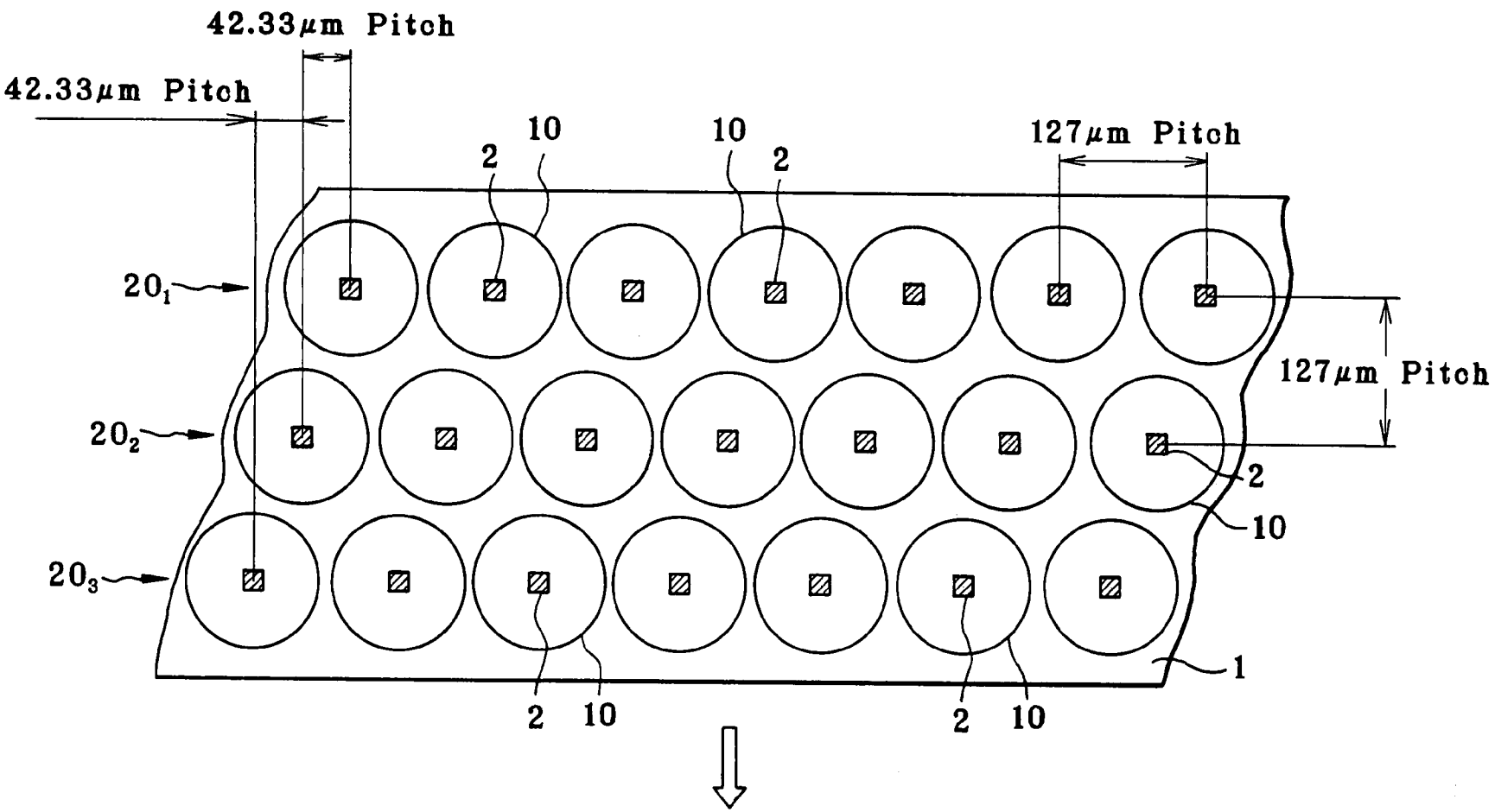
FIG. 4 is a perspective view of the organic EL array exposure head comprising a plurality of rows of light emitters according to the invention, as viewed from the image carrier side.

It is noted that no particular limitation is imposed on the pitch between the rows $\mathbf{20}_1$, $\mathbf{20}_2$ and $\mathbf{20}_3$ in the columnar direction; in the embodiment of FIG. 4, however, the pitch of each row $\mathbf{20}_1$, $\mathbf{20}_2$, $\mathbf{20}_3$ in the row direction has the same value of 127 μm so as to achieve the same resolving power in the main scanning and sub-scanning directions.

Figure 5:
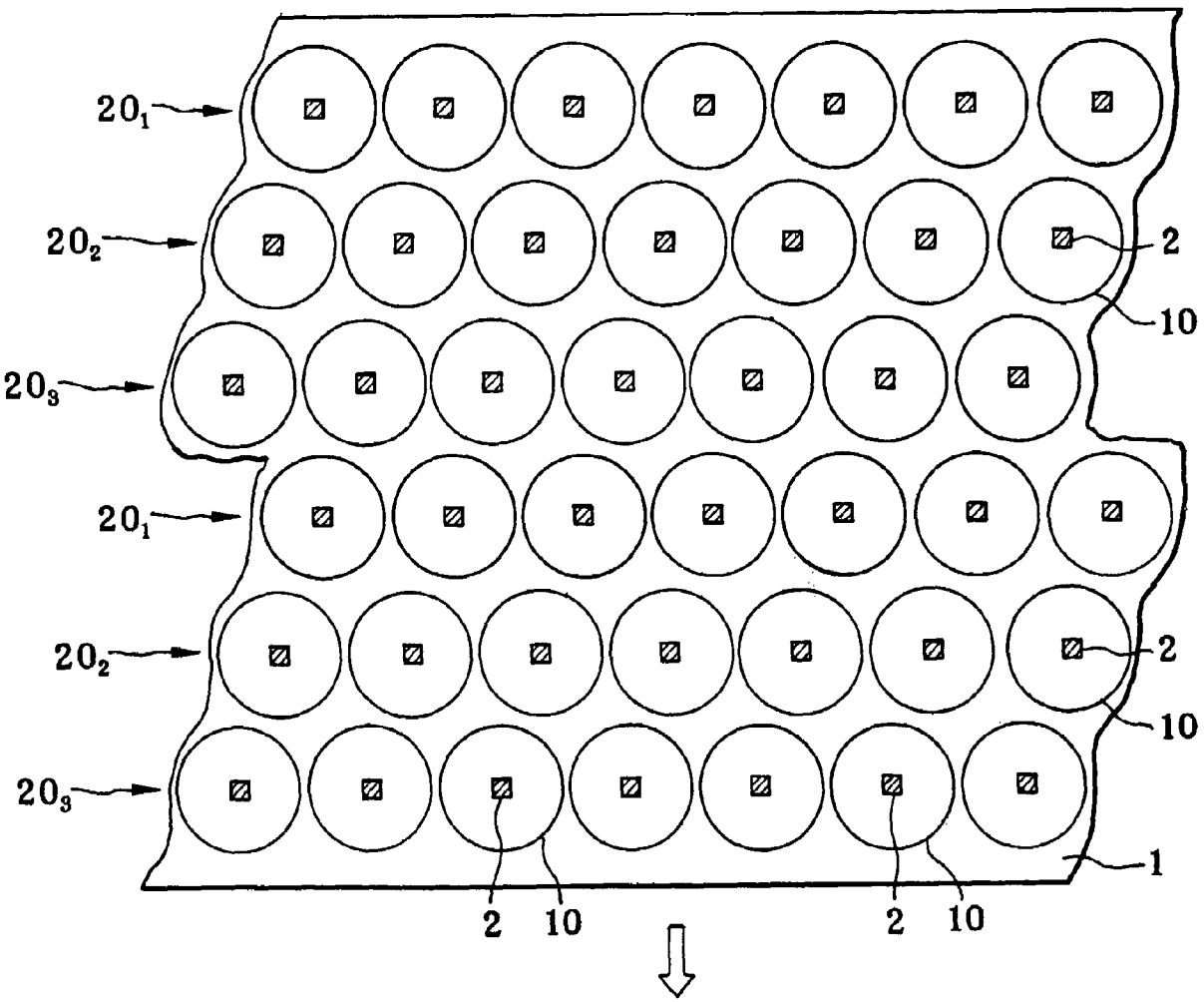
FIG. 5 is similar to FIG. 4, showing one modification to FIG. 4.

In this connection, when the quantity of light exposure to the surface onto which an image is to be projected (the surface of the image carrier 11) is insufficient for one pixel that is the image 2' of the light emitter 2 and the photosensitization of the image carrier 1 by one light emission of the light emitter 2 is insufficient, an exposure head may be set up by the juxtaposition in the columnar direction of sets of rows $\mathbf{20}_1$, $\mathbf{20}_2$ and $\mathbf{20}_3$ of FIG. 4 in the number corresponding to the number of multiple exposures as shown in FIG. 5, so that a plurality of the same exposures can occur in a superposed fashion for each pixel formed on the image carrier 11.

When the size s of each light emitter of the organic EL array 1 is reduced as described above, the quantity of light utilized for exposure (the efficiency of utilization) is now considered.

Suppose now that a light-emitting point A exists within a substrate (organic EL device) 18 having a refractive index n. By virtue of the presence of a total reflection critical angle $\theta_c$ due to the refractive index of the substrate 18, light propagating from within the device at an exit angle θ toward an interface is taken out of the device provided that $\theta_c > \theta$. The emission intensity of a surface light emitter using isotropic light emission such as an organic EL device conforms to Lambert's law. Given $I(\theta)=I_0 \cos\theta$, integration with respect to the solid angle of an upper half gives $$\int I_0 \cos\theta \, d\Omega = 2\pi I_0 \int_0^{\pi/2} \cos\theta \sin\theta \, d\theta = \pi I_0 \sin^2 \pi/2 = \pi I_0 \tag{9}$$

Here Ω is a solid angle. Division of the quantity of light radiated within the critical angle $\theta_c$ by the total quantity of light $\pi I_0$ gives $$(2\pi I_0/\pi I_0) \int_0^{\theta_c} \cos\theta \sin\theta \, d\theta = 1/n^2 \tag{10}$$

Therefore, the efficiency of light extraction of the organic EL device itself is represented by $1/n^2$.

If the refractive index of the device substrate is n=1.5, the efficiency of light extraction is then calculated to be 44.4%.

When a collective rod lens array is used as a projection optical system for the projection of the image of the light emitter 2 of the organic EL onto the image carrier 11 as in the prior art, the efficiency of utilization of light of the optical system is found by multiplying the above calculated value of 44.4% by a collection coefficient of 7% that is substantially the collection coefficient of the collective rod lens array, say, 0.444×0.07≈0.031. In other words, 3.1% of the total quantity of light emitted out of the organic EL device are utilized to form an image on the image carrier 11.

On the other hand, when the ball lens 10 is located in contact with or near to the surface of the light emitter 2 as in the invention, it is possible to collect 30% of the intensity of light from the surface of the light emitter 2 onto the image carrier 11, as calculated by ray tracing.

It is thus possible to achieve the efficiency of utilization of about ten times as high as that achieved with the collective rod lens array.

It is here noted that a collective rod lens array provides an optical system of 1× magnification wherein the size of the light emitter 2 is substantially the same as the size of an image formed on the image carrier 11, whereas the exposure head of the invention takes the form of a magnifying optical system wherein, as described above, the size of the light emitter 2 must be more reduced than the pixel size on the image carrier 11 by factor of the magnifying rate. However, if the light emitter 2 used is of the same luminance, the area of the light emitter 2 can then be reduced to 1/10 (a magnifying rate of 3.2) as compared with the collective rod lens array while the same light intensity is maintained of the pixels on the image carrier 11. It is thus possible to achieve some considerable reductions in the power consumed by the exposure head.

Figure 7:
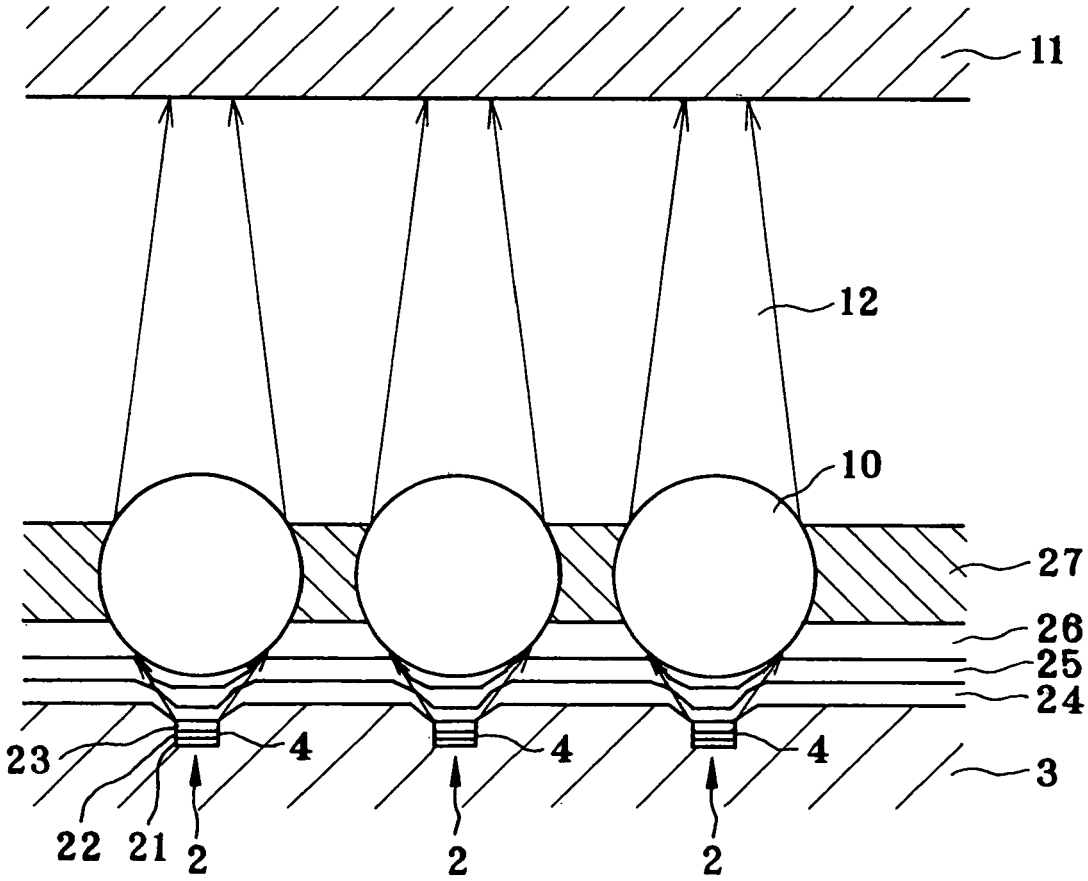
FIG. 7 is schematically illustrative of one specific embodiment of the organic EL array exposure head according to the invention.

The present invention is now explained with reference to FIG. 7 that is schematically illustrative in section of one specific embodiment of the organic EL array exposure head according to the invention. While a transparent cathode 24, a sealing layer 25 and an adhesive layer 26 between a light emitter 2 and an associated ball lens 10 are shown to be thicker than actually required, it is understood that the distance from the light emitter 2 to the ball lens 10 is set at 7% or less of the diameter of the ball lens 10.

An organic EL device is generally designed to extract light from either a cathode or an anode. In this embodiment, the light is extracted from the cathode side. More specifically, the surface of a substrate 3 formed of glass, silicon or the like is provided at a given pitch with a row of holes 4 for receiving light emitters of the organic EL device. On the bottom of each hole 4, an anode 21 wherein an ITO or the like is laminated on a reflective metal film formed of a magnesium/silver alloy, aluminum or the like, a hole-injecting layer 22 and a light-emitting layer 23 are stacked in this order. A transparent cathode 24 that is thin enough to transmit light is provided all over the surface of the substrate 3 in such a way as to be in contact with the light-emitting layers 23 in the holes. A light emitter 2 corresponding to each hole 4 has a structure wherein the light-emitting layer 23 capable of transporting electrons and the hole-injecting layer 22 are stacked one upon another, so that electrons and holes injected from the transparent cathode 24 and anode 21, respectively, can be recombined to emit light.

A sealing layer 25 is provided on the transparent cathode 24 for prevention degradation of the light-emitting layer 23 by touch with moisture, and an adhesive layer 26 formed of transparent resin is provided thereon to fix ball lenses 10 in alignment with the respective light emitters 2 with respect to the substrate 3. A black resin 27 is filled between adjacent ball lenses 10 at an area except an effective surface from which a projection light beam 12 is to emerge, thereby absorbing noise light such as crosstalk light occurring as a result of a light beam that emerges from a specific light emitter 2 but is incident on an unassociated pixel position via a ball lens 10 adjacent to the associated ball lens 10, and flare light occurring as a result of repeated total reflections of the light beam within the ball lens 10.

Figure 8:
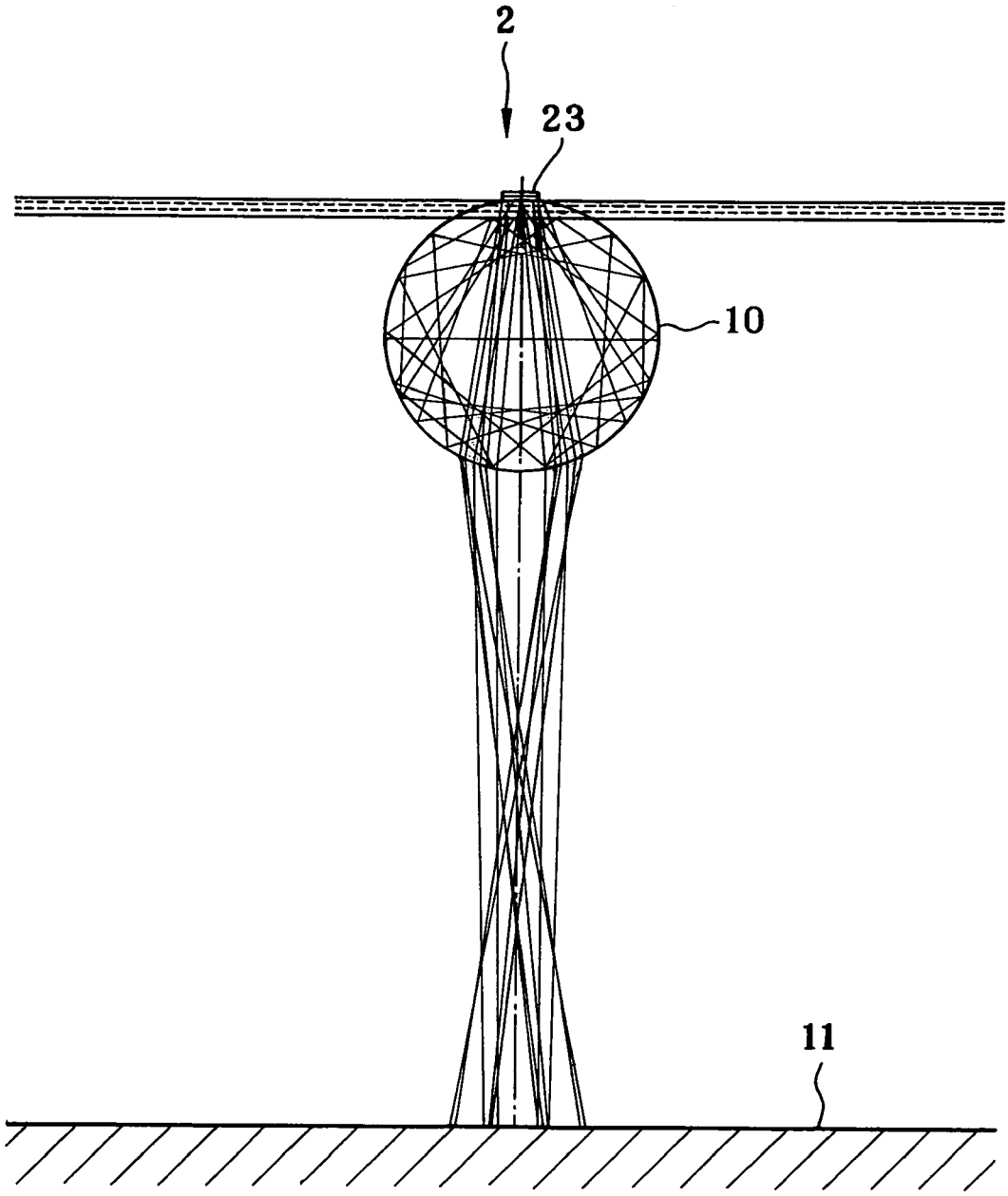
FIG. 8 is a diagram for illustrating one example of optical path tracing for light rays leaving a light-emitting layer of one pixel and arriving at an image carrier via the associated ball lens.
Figure 9:
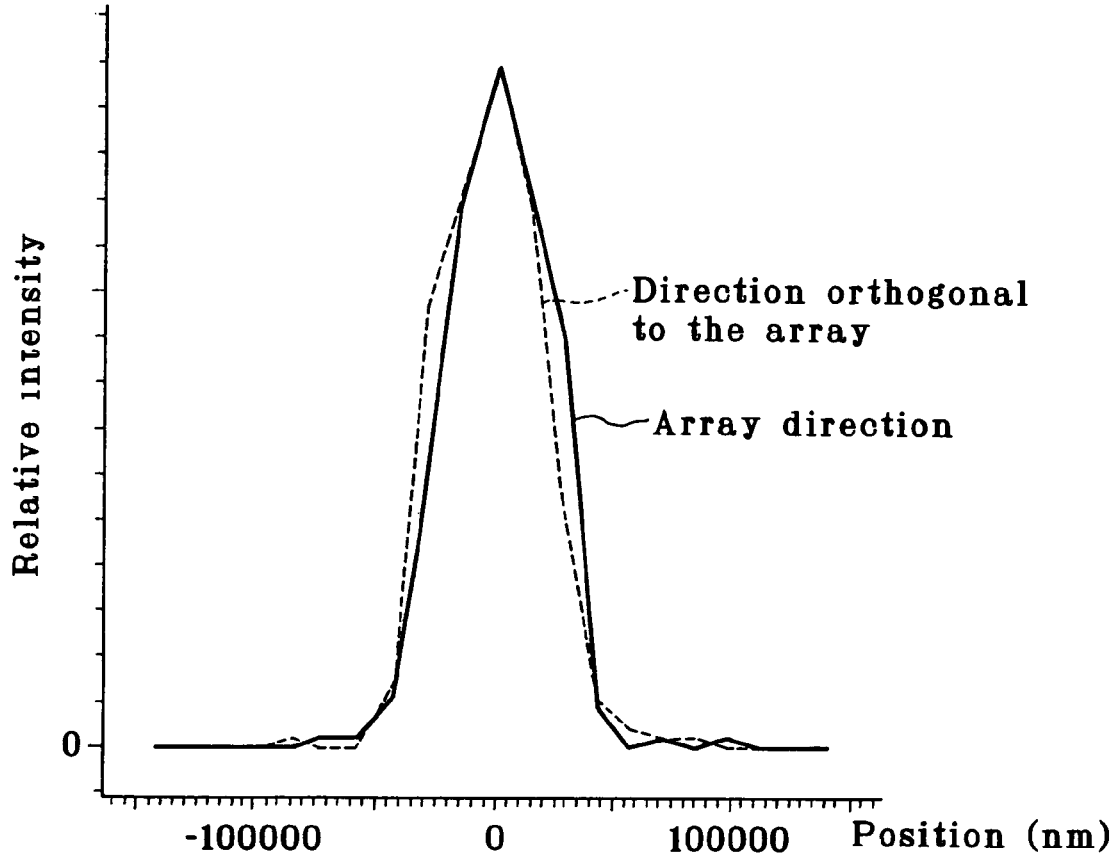
FIG. 9 is a light-quantity profile on the image carrier in the embodiment of FIG. 8.

Referring to FIG. 8, there is shown one example of the ray tracing diagram where light rays from the light-emitting layer 23 in one pixel (light emitter 2) to the image carrier 11 via an associated ball lens 10 are traced. The then light quantity profile on the image carrier 11 is depicted in FIG. 9. In this example, the light-emitting layer is of □10 μm (10 μm×10 μm) in size and the ball lens 10 has a diameter of 120 μm and a refractive index of 2.2. The distance between the surface of the light-emitting layer 23 and the surface apex of the ball lens on the entrance side is 3 μm, and the distance between the surface apex of the ball lens 10 on the exit side and the image carrier 11 is 300 μm. The layers (transparent electrode 24, sealing layer 25 and adhesive layer 26) between the light-emitting layer 23 and the ball lens 10 have a refractive index of 1.5. From FIG. 9, it is seen that by using one light emitting-layer of □10 μm (10 μm×10 μm) as a pixel of □50 μm (50 μm×50 μm) in size on the image carrier 10, efficient projection exposure can be achieved with a sufficient resolving power yet with little or no crosstalk.

Figure 10:
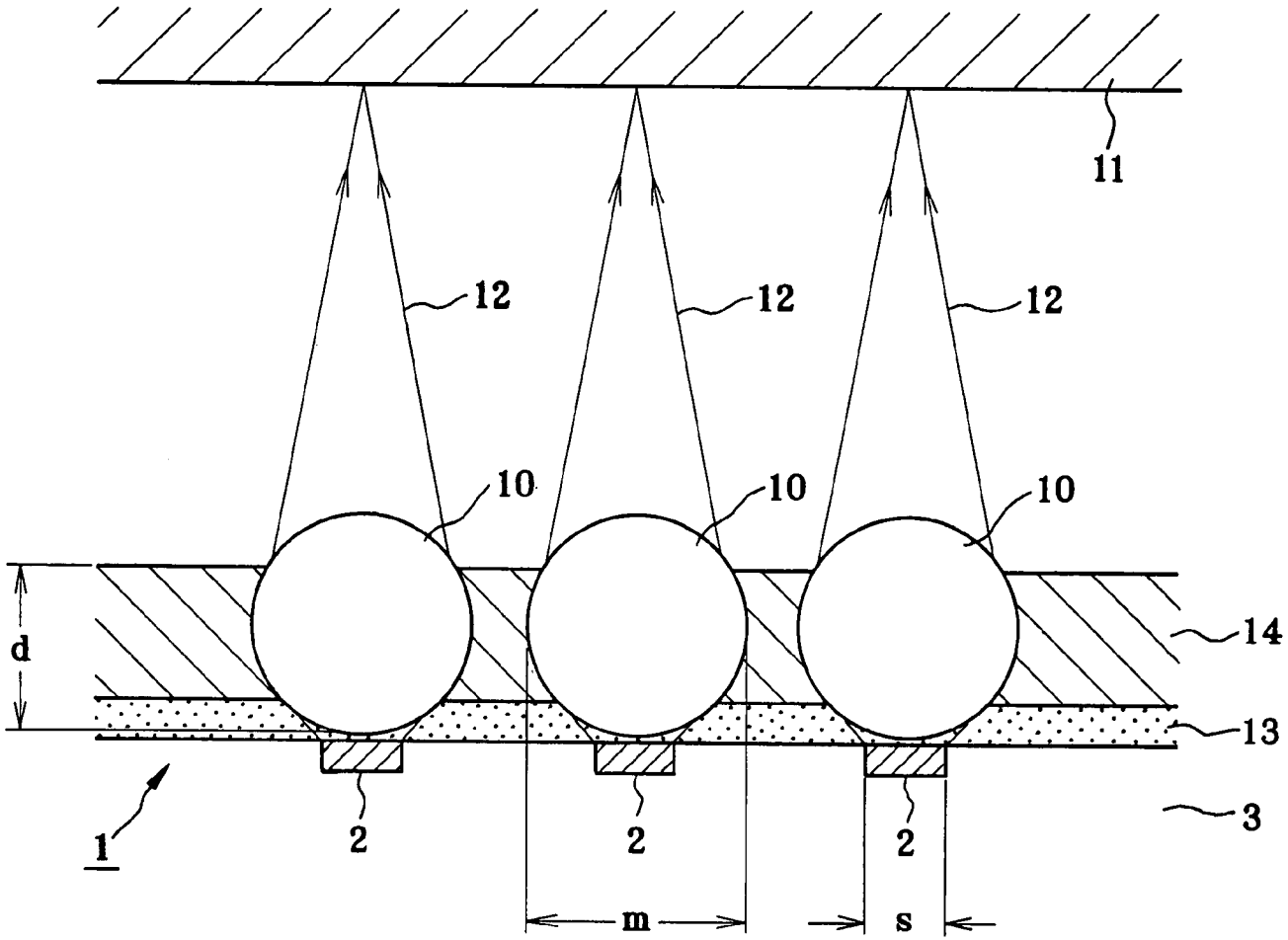
FIG. 10 is schematically illustrative in section of the basic construction of the second aspect of the organic EL array exposure head according to the invention.

The second aspect of the organic EL array exposure head according to the invention is now explained. FIG. 10 is schematically illustrative in section of the basic construction of the second aspect of the organic EL array exposure head according to the invention. As shown, the surface of a substrate 3 is provided with organic EL emitters 2 at a constant period to set up an organic EL array 1. According to the invention, ball lenses of the same shape and properties are positioned in one-to-one relations to the emitters 2 of the organic EL array 1 in such a way that light beams 12 from the respective emitters 2 are split and projected by the associated ball lenses 10 onto an image carrier 11 formed of a photosensitive material (for electrophotography), which forms a member onto which an image is to be projected. It is noted that the ball lens 10 referred to is a single positive lens formed of a transparent sphere.

Each ball 10 should be positioned in contact with or near to the surface of the associated light emitter 2, so that nearly all of divergent light leaving the light emitter 2 can enter the associated ball lens 10. It is here noted that if the diameter s of the light emitter 2 is much lager than the diameter m of the ball lens 10 and the ball lens 10 is in contact with the surface of the light emitter 2, almost 100% of the light can then enter the ball lens 10. Thus, it is possible to reduce cross-talk—a phenomenon wherein the light emerging from the light emitter 2 is incident on an unassociated pixel position via a ball lens 10 adjacent to the associated ball lens 10.

The ball lenses 10 positioned in one-to-one relations with the emitters 2 of the organic EL array 1 are bonded to the substrate 3 through a transparent adhesive layer 13. In the embodiment of FIG. 10, a fixing layer 14 formed of a black resin or the like is further filled between adjacent ball lenses 10 at an area except an effective surface through which a projection light beam 12 is to emerge, thereby assuring more firm fixation of the ball lenses 10.

The thickness d of the ball lens 10 from the surface apex on the entrance side to the upper surface of the fixing layer 14 depends on the refractive index of the ball lens 10. Typically, when the refractive index of the ball lens 10 is n=2, the thickness d is set at 0.75 m where m is the diameter of the ball lens 10, and at n=2.2, the thickness d is set at about 0.8 m.

Figure 11:
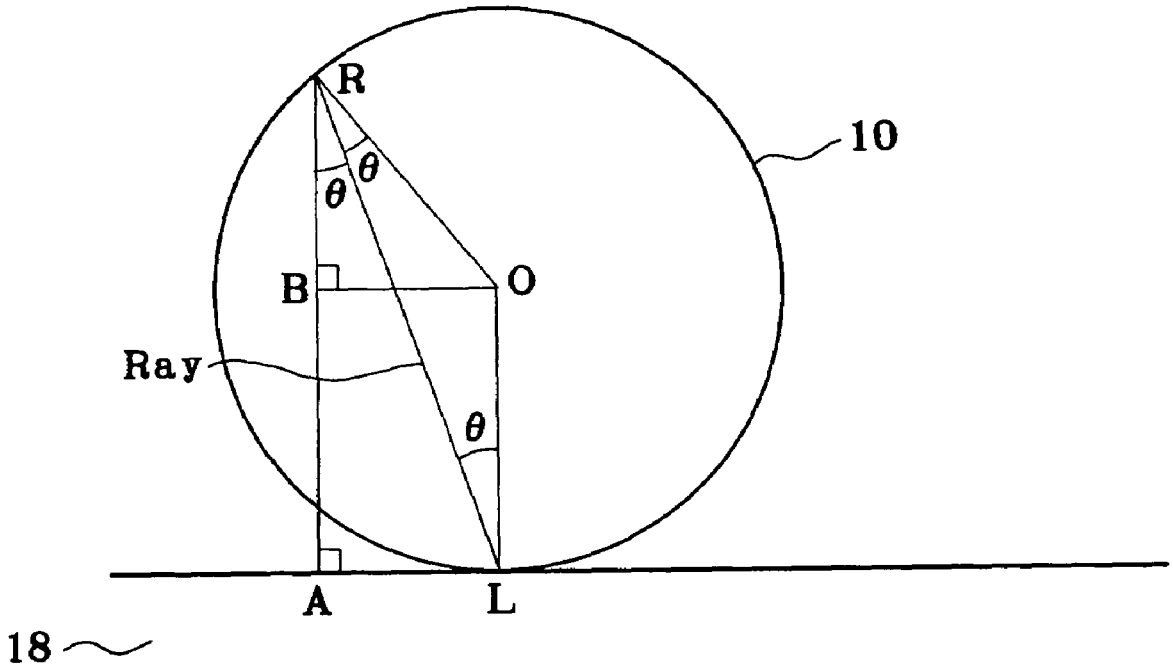
FIG. 11 is a schematic for explaining the meaning of why the thickness of a fixing layer must be limited.

What is meant by the thickness d is now explained. Presume now that, as shown in FIG. 11, the ball lens 10 is in contact with the light emitter 2 at one lowermost point L. If an angle θ (with respect to perpendicular) of propagation of a light ray incident from this lowermost point L on the ball lens 10 is greater than an angle between the ball lens 10 and an air interface, that light ray does not leave the ball lens 10 because of being subject to continued total reflections within the ball lens 10.

As shown in FIG. 11, let R be a point of intersection of a light ray from the entrance point L at the angle θ of propagation with the ball lens 10, A be a point of intersection of a perpendicular from R down to the surface of a substrate 18 with the surface of the substrate 18, and B be a point of intersection of that perpendicular with a perpendicular to the center O of the ball lens 10. Then, $$\angle ORL=\angle OLR=\theta(\because OR=OL) \tag{11}$$

$$\angle BRL=\angle OLR=\theta(\because OL \text{ is parallel with } BR) \tag{12}$$

$$\because \angle ORB=\angle OLR+\angle BRL=2\theta \tag{13}$$

Let m be the diameter of the ball lens 10. Then, $$BR=OR\cos 2\theta=(m/2)\cos 2\theta \tag{14}$$

$$AB=(m/2) \tag{15}$$

Therefore, the height AR of the point R becomes $$AR=AB+BR=(m/2)(1+\cos 2\theta) \tag{16}$$

Let α be the critical angle between the ball lens 10 and the air interface and n be the refractive index of the ball lens 10. Then, $$\sin\alpha=1/n \tag{17}$$

Hence, $$\cos 2\alpha=\cos^2\alpha-\sin^2\alpha=1-2\sin^2\alpha=1-2/n^2 \tag{18}$$

At θ≦α, that light ray leaves the ball lens 10. However, substituting θ≦α into equation (16) gives $$Ar\geqq(m/2)(1+\cos 2\alpha)=m(1-1/n^2) \tag{19}$$

This means that the light ray can emerge from only a site of height that satisfies equation (19) concerning the ball lens 10, and that even when other sites are covered with the fixing layer 14 formed of a black resin or the like, there is no detriment to the function of the ball lens 10.

Suppose here that at n=2, the thickness d of the lens ball 10 up to the upper surface of the fixing layer 14 is d≦0.75 m, and at n=2.2, d=0.793 m≈0.8 m or less. Then, the ball lens 10 can be firmly fixed onto the light emitter 2 of the organic EL array 1 without cutting off the light beam 12 emerging form the light emitter 2, which is projected onto the image carrier 11 to form a pixel thereon.

The fixing layer 14 is not necessarily formed of a transparent material. In consideration of possible noise light such as crosstalk light occurring as a result of a light beam that emerges from a specific light emitter 2 but is incident on an unassociated pixel position via a ball lens 10 adjacent to the associated ball lens 10, and flare light occurring as a result of repeated total reflections of the light beam within the ball lens 10, however, it is preferable to form the fixing layer 14, using a light-absorbable black resin or the like.

To allow light beams leaving the ball lenses 10 located in contact with or near to the surfaces of the light emitters 2 to be split as pixels for incidence on the image carrier 11, the ball lens 10 should be formed of a transparent material having a refractive index of at least 2 with respect to light emitted out of the light emitter 2. Glass materials having a refractive index of 2 or more, for instance, include bismuth-based glasses, glasses containing much heavy metals or optical crystals.

When ball lenses 10 having a refractive index of 2 or greater are positioned in contact with or near to the surfaces of light emitters 2, light beams 12 leaving the light emitters 2 via the ball lenses 10 are split into parallel or converging light rays for incidence on the image carrier 11, as explained with reference to FIG. 2. Thus, the organic EL array 1 comprising such ball lenses 10 positioned in contact with or near to the surfaces of the light emitters 2 in one-to-one relations can be used as an exposure head.

For the purpose of reducing crosstalk as mentioned above, it is still desirable to satisfy the relation defined by equation (8) as described with reference to FIG. 3.

Figure 12:
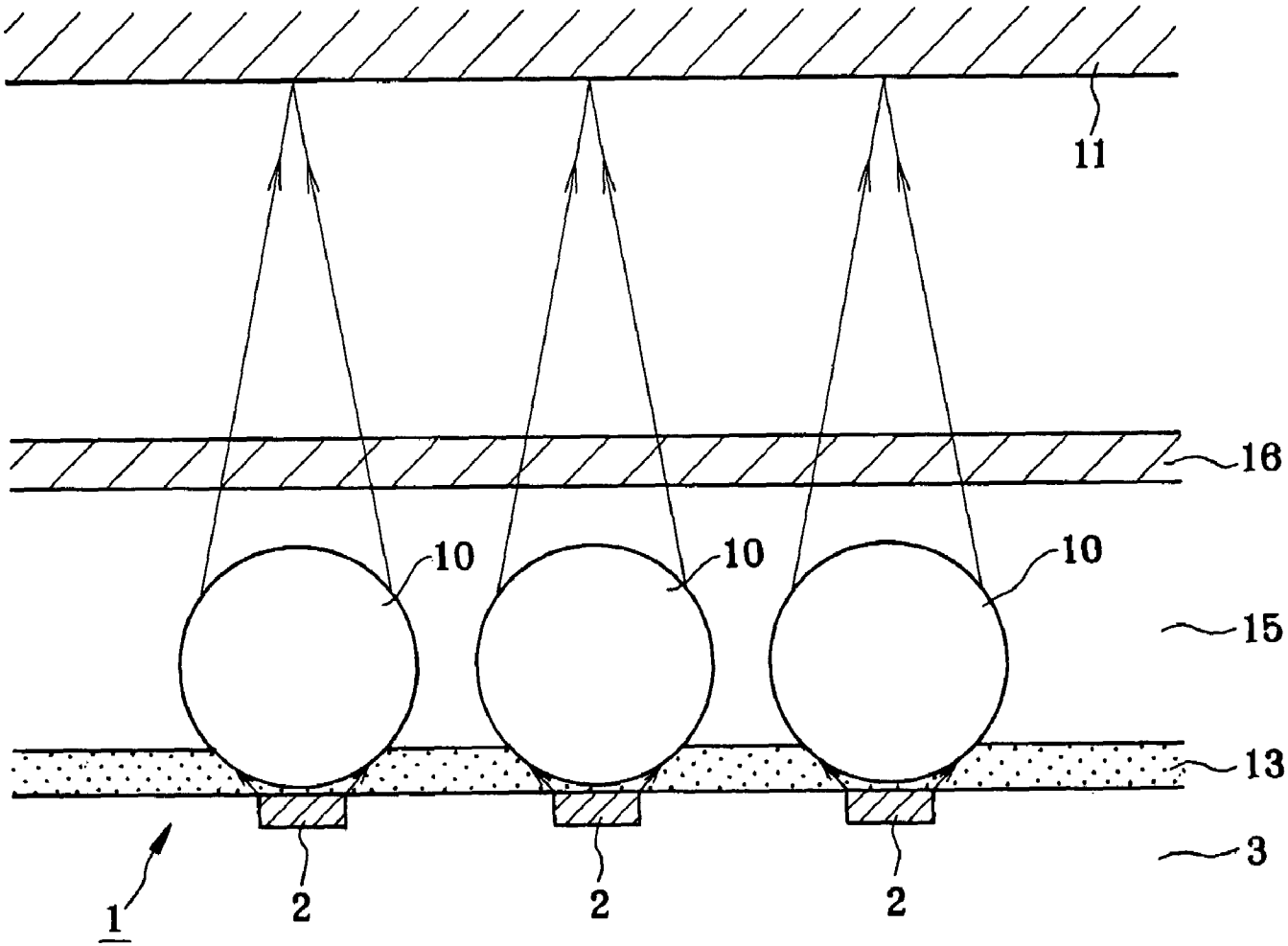
FIG. 12 is similar to FIG. 10, showing an embodiment where silica aerogel is used as the fixing layer.

It is here noted that when a transparent material having a refractive index close to 1 is selected for the material for the fixing layer, equation (19) concerning height is not necessarily satisfied; the fixing layer may be filled between adjacent ball lenses 10 in such a way that the ball lenses 10 are embedded therein. Among such transparent materials having a refractive index close to 1, there is aerogel (for instance, see non-patent publication 1). One typical aerogel is silica aerogel. An example of using the silica aerogel for the fixing layer is shown in FIG. 12. As shown in FIG. 12 that is similar to FIG. 10, ball lenses 10 of the same shape and properties are positioned and bonded by a transparent adhesive layer 13 to a substrate 3 in one-to-one relations to light emitters 2 of an organic EL array 1. A silica aerogel layer 15 having a refractive index close to 1 is provided in such a way as to cover an area between adjacent lens balls 10 and the exit-side surfaces thereof. Consequently, each ball lens is embedded in the silica aerogel layer 15 in its entirety, so that the ball lenses 10 can be firmly fixed onto the light emitters of the organic EL array 1.

However, a transparent protective layer 16 is provided over the surface of the silica aerogel layer 15. The reasons are that silica aerogel has a very high porosity, and so when the silica aerogel layer 15 remains unprotected, it may possibly take up moisture in the air to such an extent that the refractive index or other physical properties change or toner or other particles may possibly enter surface pores too deeply to remove them. The transparent protective layer 16 is formed of ITO or other transparent conductive layer. In addition, if the transparent conductive layer is controlled in such a way as to have the same potential as that of a toner in a developer in an electrophotographical system, it is then possible to prevent fouling of the optical system in the organic EL array exposure head 1 with toner particles, which may otherwise lead to poor exposure or other defects.

Figure 13:
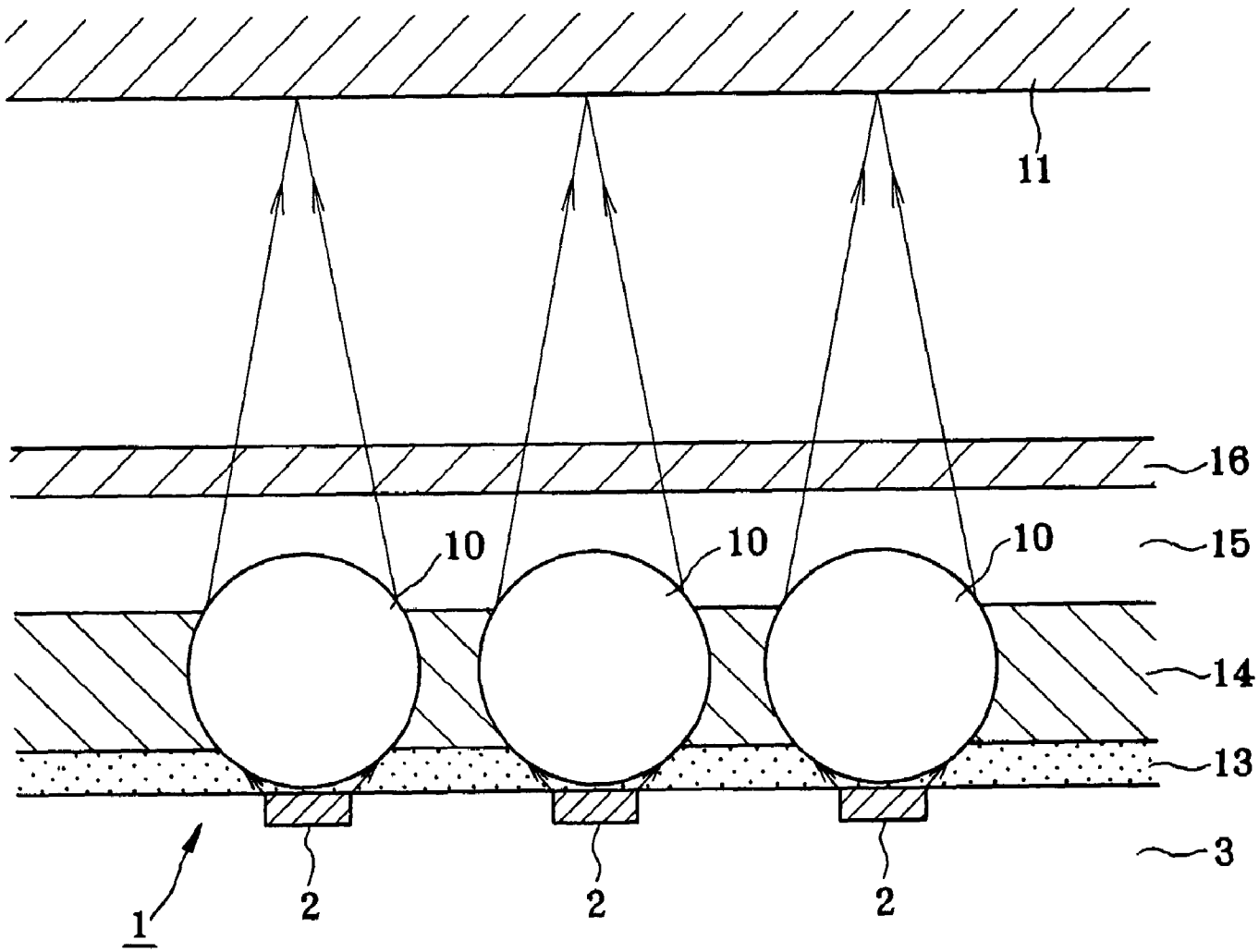
FIG. 13 is similar to FIG. 10, showing an embodiment wherein a silica aerogel layer is provided on the fixing layer of FIG. 10.

FIG. 13 is a view similar to FIG. 10, showing another embodiment wherein a silica aerogel layer 15 having a refractive index close to 1 is provided over a fixing layer 14 that is formed of a black resin or the like as shown in FIG. 10 in such a way as to cover the whole surfaces of ball lenses 10 on the exit side, and a transparent protective layer 16 is provided over the surface of the silica aerogel layer 15. In this case, too, it is desired to form the transparent protective layer 16 using an ITO or other transparent conductive layer. It is again noted that the fixing layer 14 is filled between ball lenses 10 at an area having a height of up to the distance $m(1-1/n^2)$.

Figure 6:
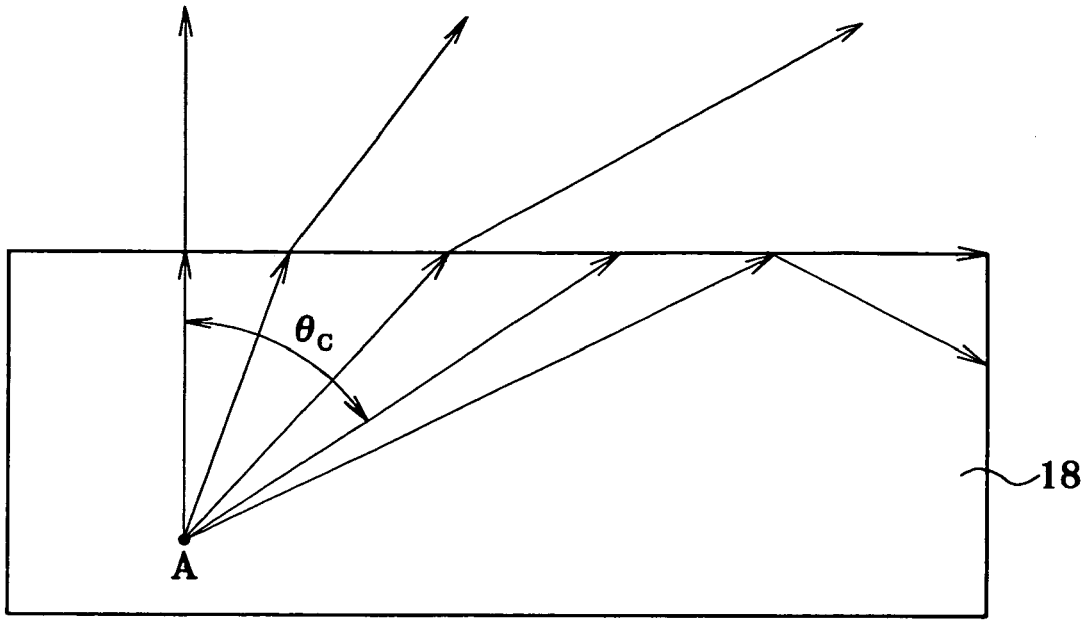
FIG. 6 is a schematic for studying the efficiency of extracting light out of an organic EL device itself.

Regarding the quantity of light (efficiency of utilization) used for exposure where the size s of the light emitters 2 of the organic EL array 1 is reduced, comparisons with where a collective rod lens array is used as a projection optical system for the projection of the light emitters 2 onto the image carrier 11, etc., see the explanation made with reference to FIG. 6. Therefore, if the light emitter 2 used is of the same luminance, the area of the light emitter 2 can then be reduced to 1/10 (a magnifying rate of 3.2) as compared with a collective rod lens array while the same light intensity is maintained of the pixel on the image carrier 11. It is thus possible to achieve some considerable reductions in the power consumed by the exposure head.

The present invention is now explained with reference to FIG. 14 that is schematically illustrative in section of one specific embodiment of the second aspect of the organic EL array exposure head according to the invention. While a transparent cathode 24, a sealing layer 25 and a transparent adhesive layer 13 between a light emitter 2 and an associated ball lens 10 are shown to be thicker than actually required, it is understood that the height of a fixing layer formed of a black resin or the like is determined in such a way as to satisfy equation (9) with respect to the effective exit surface of the ball lens 10.

An organic EL device is generally designed to extract light from either a cathode or an anode. In this embodiment, the light is extracted from the cathode side. More specifically, the surface of a substrate 3 formed of glass, silicon or the like is provided at a given pitch with a row of holes 4 for receiving light emitters of the organic EL device. On the bottom of each hole 4, an anode 21 wherein an ITO or the like is laminated on a reflective metal film formed of a magnesium/silver alloy, aluminum or the like, a hole-injecting layer 22 and a light-emitting layer 23 are stacked in this order. A transparent cathode 24 that is thin enough to transmit light is provided all over the surface of the substrate 3 in such a way as to be in contact with the light-emitting layers 23 in the holes. A light emitter 2 corresponding to each hole 4 has a structure wherein the light-emitting layer 23 capable of transporting electrons and the hole-injecting layer 22 are stacked one upon another, so that electrons and holes injected from the transparent cathode 24 and anode 21, respectively, can be recombined to emit light.

A sealing layer 25 is provided on the transparent cathode 24 for prevention degradation of the light-emitting layer 23 by touch with moisture, and an adhesive layer 13 formed of a transparent resin is provided thereon to fix ball lenses 10 in alignment with the respective light emitters 2 to the substrate 3. A fixing layer 14 formed of a black resin is filled between adjacent ball lenses 10 at an area except an effective surface from which a projection light beam 12 is to emerge, thereby fixing all the ball lenses 10 firmly onto the light emitters 2 of the organic EL array 1. This fixing layer 14 then serves to absorb noise light such as crosstalk light occurring as a result of a light beam that emerges from a specific light emitter 2 but is incident on an unassociated pixel position via a ball lens 10 adjacent to the associated ball lens 10, and flare light occurring as a result of repeated total reflections of the light beam within the ball lens 10.

Figure 14:
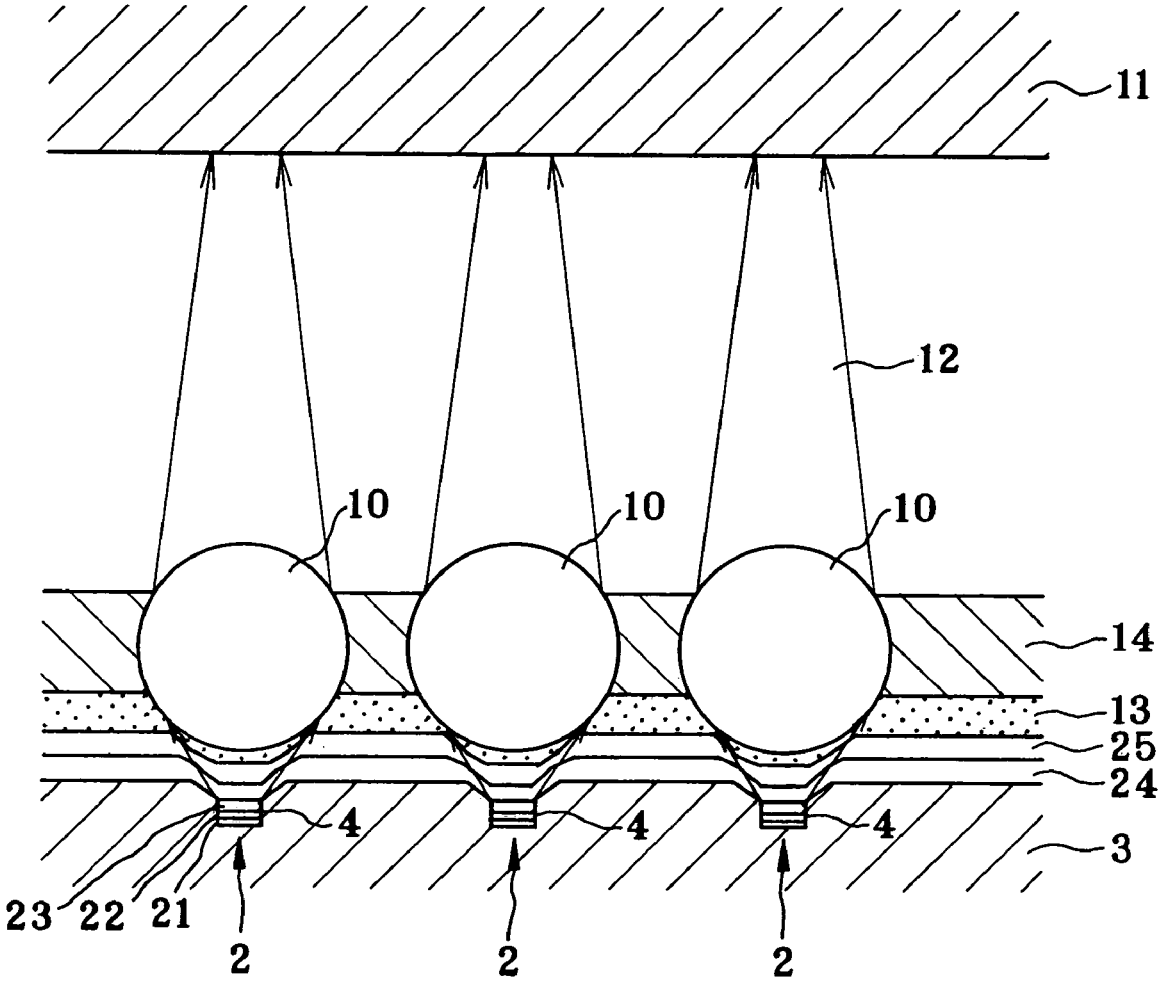
FIG. 14 is schematically illustrative in section of one specific embodiment of the organic EL array exposure head according to the second aspect of the invention.

In the embodiment of FIG. 14, it is noted that the holes 4 are provided in the surface of the substrate 3 with a larger depth. The organic EL light emitter 2 is formed at the bottom of the hole 4, and a transparent adhesive 13 having a protective function is overlaid on the organic EL light emitter 2 in such a way as to form a recess at an upper site of the hole 4. The ball lenses 10 are fitted in such recesses so that they can automatically align with the light emitters.

The present invention is now explained with reference to specific embodiments of fabricating an array-form exposure head wherein, as is the case with the above organic EL array, ball lenses are positioned in alignment with light emitters of an array-form light source. It is noted that these embodiments may be applied to an array-form light source such an LED array, let alone the organic EL array.

Figures 15A, 15B, 15C, 15D, 15E:
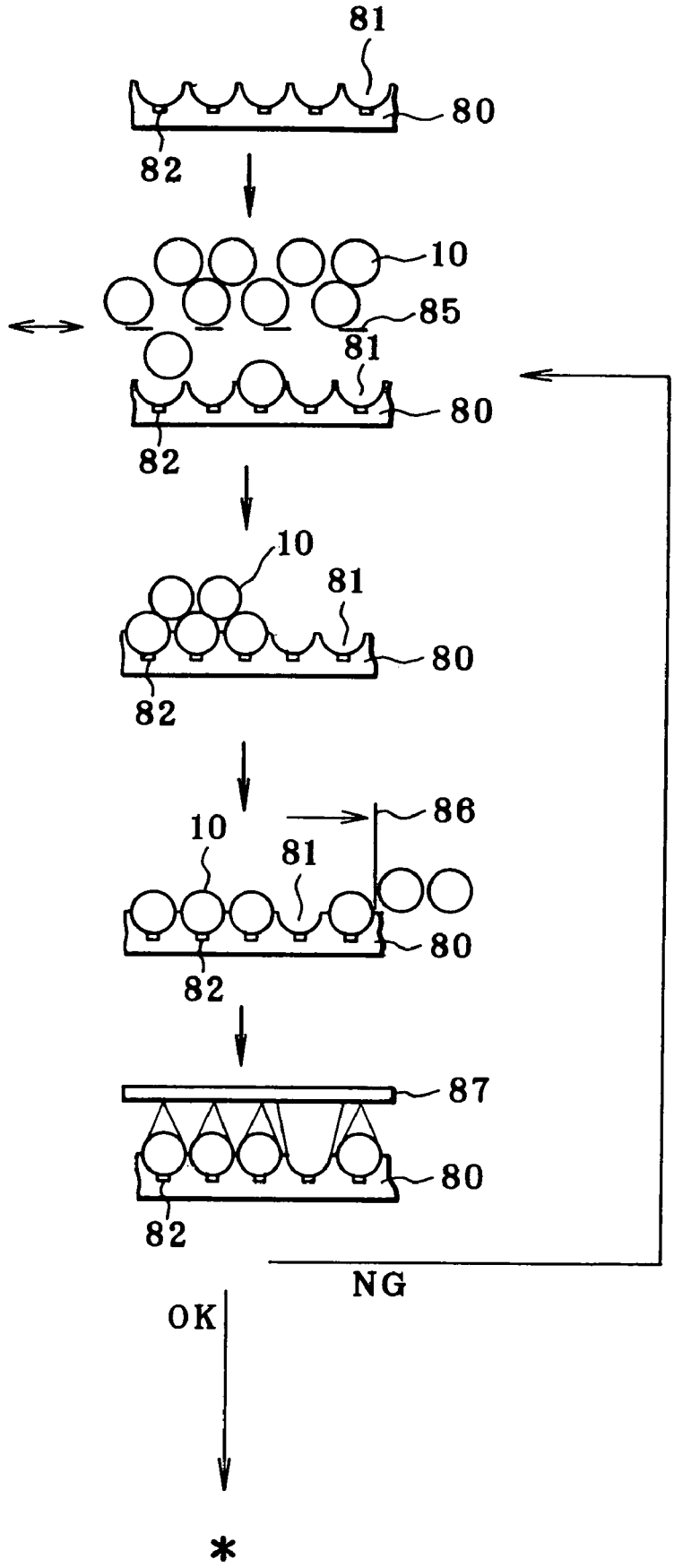
FIGS. 15(*a*) to 15(*e*) are illustrative of a series of steps inclusive of an inspection step in one specific embodiment of the array-form exposure head fabrication process according to the invention.
Figures 16A, 16B, 16C:
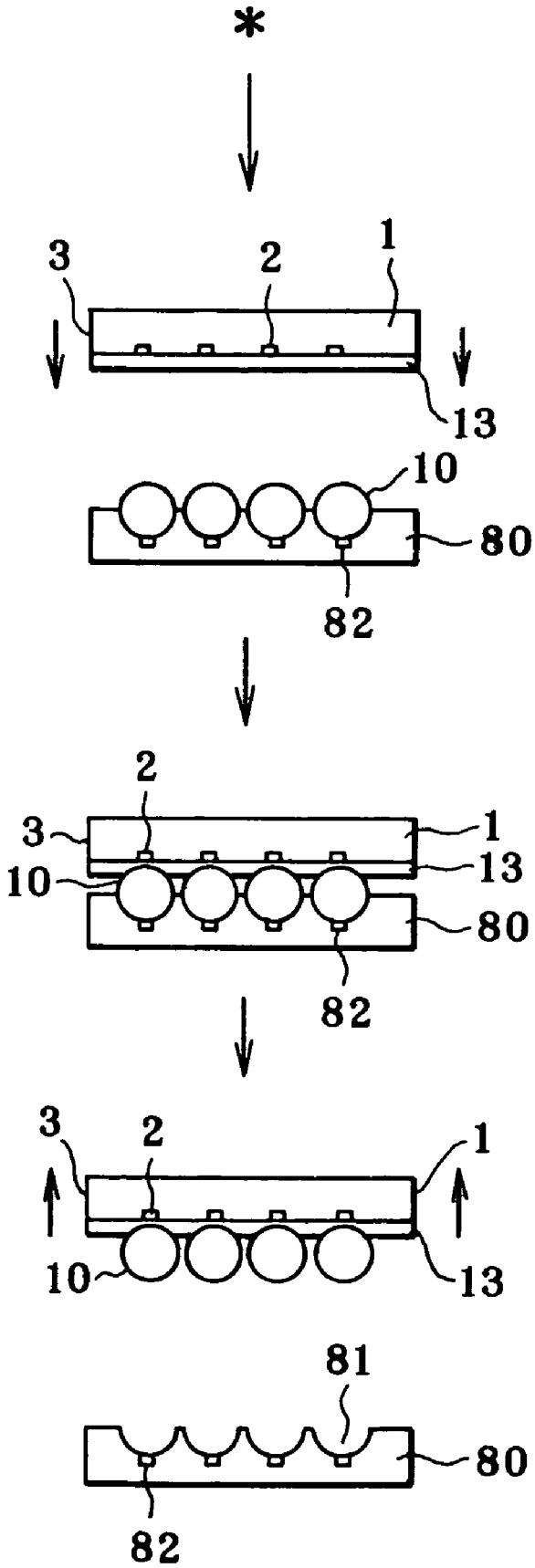
FIGS. 16(*a*), 16(*b*) and 16(*c*) are illustrative of how a group of ball lenses put in order through the steps of FIGS. 15(*a*) to 15(*e*) are bonded to the array-form light sources while in alignment therewith.
Figure 17A:
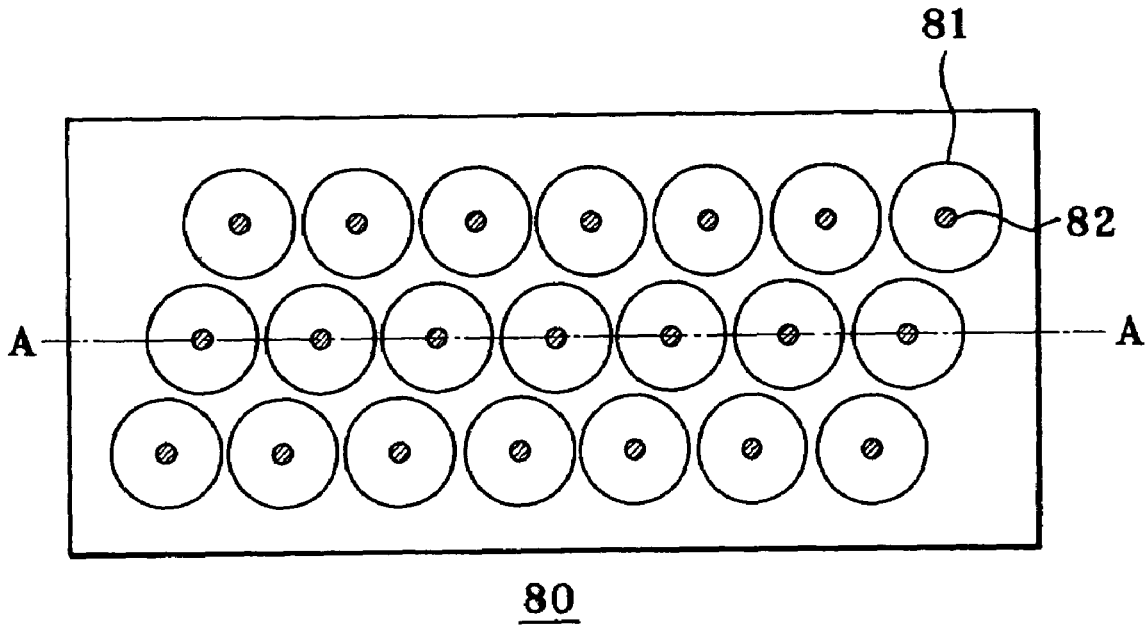
FIGS. 17(*a*) and 17(*b*) are a plan and a sectional view of a ball lens alignment mold, respectively.
Figure 17B:
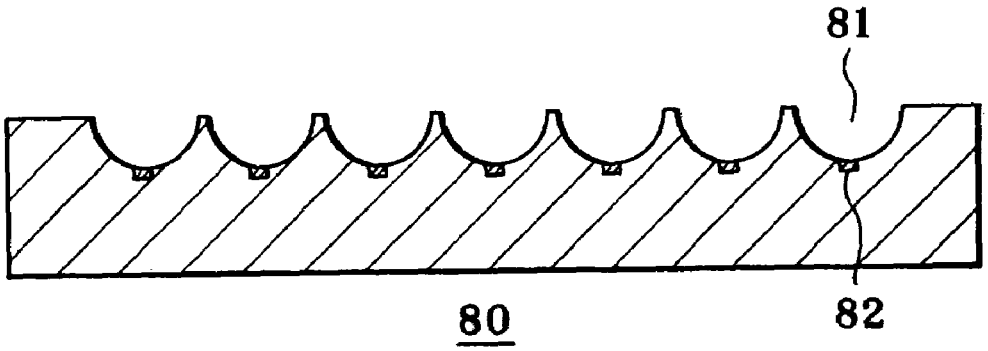
Figure 18A:
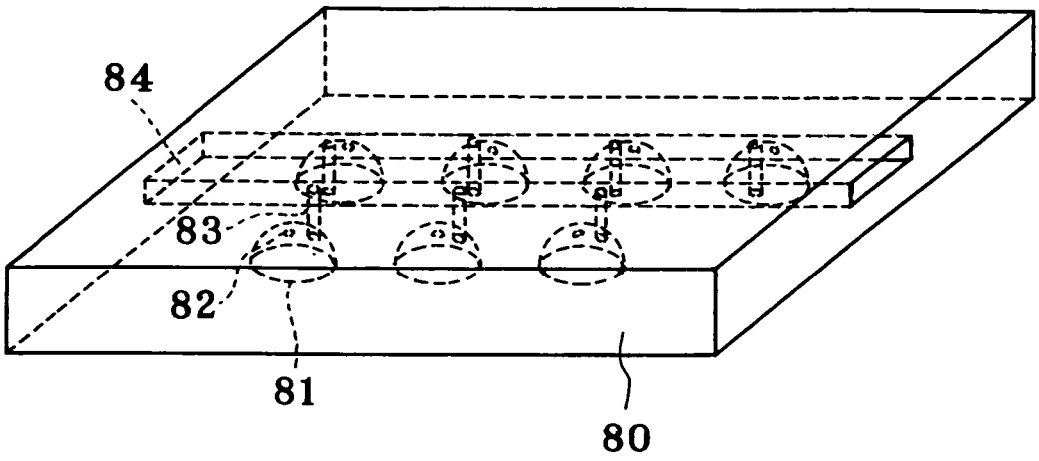
FIGS. 18(*a*) and 18(*b*) are a perspective and a sectional view of a ball lens suction mechanism through the ball lens alignment mold, respectively.
Figure 18B:
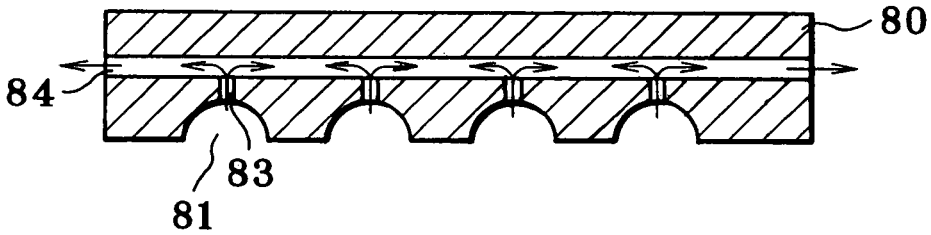

FIGS. 15 and 16 are provided for explaining the steps of one specific embodiment of fabricating the array-form exposure head according to the invention. Such a ball alignment mold 80 as shown in FIG. 15(*a*) is first provided. As shown in FIG. 17(*a*) that is a plan view as viewed from the side of ball lens-receiving holes 81 and FIG. 17(*b*) that is a sectional view as taken on line A-A of FIG. 17(*a*), the ball lens alignment mold 80 is provided on one surface with an array form of hemispherical ball lens-receiving holes 81, which are arranged in alignment with light emitters 2 of an array-form light source 1 and have a diameter that is equal to slightly larger than the diameter of the ball lenses 10 used. It is here noted that the mold 80 shown in FIG. 17 is provided for an organic EL array 1 comprising three rows of light emitters 2 shown in FIG. 4. A light-emitting device 82 such as a LED is located at the center of the bottom of each ball lens-receiving hole 81. Although not shown in FIGS. 15, 16 and 17, one end of a suction hole 83 is open at a position off the center of the bottom of each ball lens-receiving hole 81 and the other end is connected to a suction pip 84 provided through the substrate of the ball lens alignment mold 80, as shown in FIGS. 18(*a*) and 18(*b*) that are a perspective and a sectional view of the ball lens alignment mold 80, respectively.

As shown in FIG. 15(*b*), while a sieve 85 adapted to pass ball lenses 10 having a given diameter in a selective fashion is vibrated in a direction indicated by a double-action-arrow, all ball lenses 10 passing through the sieve 85 are simultaneously cast from a height where the ball lenses 10 are unlikely to chip off onto the side of the mold 80 at which the ball lens-receiving holes 81 are open, whereupon the ball lenses are placed in a state as shown in FIG. 15(*c*). It is here noted that in the steps shown in FIGS. 15(*a*) to 15(*c*), negative pressure is applied to the ball lens-receiving holes 81 by way of the suction pipe 84 and suction holes 83, so that the fitting of the ball lenses 10 in the holes 81 is facilitated and the lens balls 10 are held in place.

Then, as shown in FIG. 15(*d*), excessive ball lenses 10 that are not fitted into the ball lens-receiving holes 81 are removed from the ball lens alignment mold 80 by means of a brush 86.

In the step of FIG. 15(*c*), it is desired that the ball lens alignment mold 80 be fluctuated to facilitate the fitting of the ball lenses 10 in the ball lens-receiving holes 81. In the step of FIG. 15(*d*), excessive lens balls 10 that are not fitted in the ball lens-receiving holes 81 be scraped off while the ball lens alignment mold 80 is inclined; when a ball lens suction mechanism comprising the suction pipe 84 and suction holes 83 is incorporated in the ball lens alignment mold 8 as in the instant embodiment, however, it is acceptable to remove such excessive lens balls 10 by turning the ball lens alignment mold 80 upside down.

Figure 19:
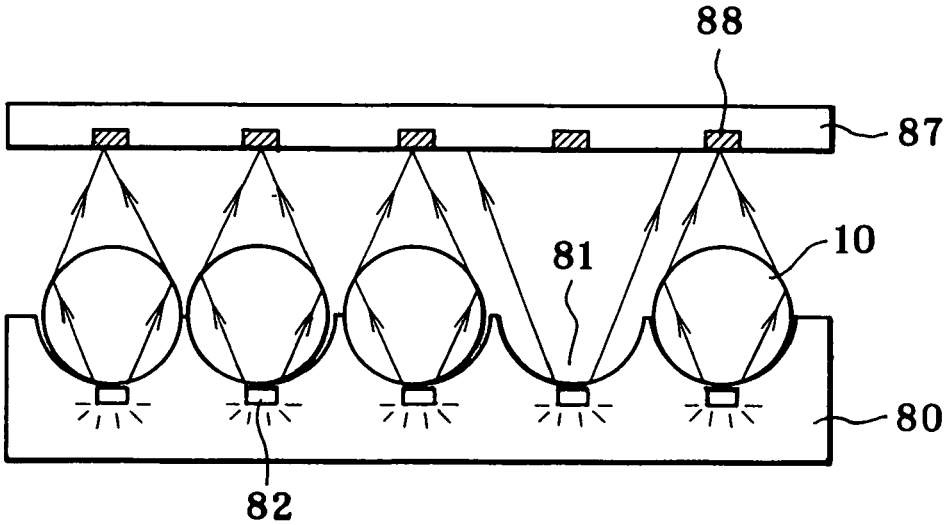
FIG. 19 shows the inspection step of FIG. 15(*e*) on an enlarged scale.

In a step of FIG. 15(*e*) subsequent to the step of FIG. 15(*d*), whether or nor the ball lenses 10 are all put in order is inspected. To this end, as shown in FIG. 19 on an enlarged scale, an inspection jig 87 is positioned above and at a given distance from the ball lens alignment mold 80 with the ball lenses 10 received in the aligned holes 81. A substrate forming the inspection jig 87 is provided on its surface with optical sensors 88 in alignment with the light emitters 2 on the array-fom light source to be inspected. On the other hand, a light emitter 82 is located at the center of the bottom of each ball lens-receiving hole 81. Divergent light leaving the light emitter 82 at the bottom of the ball lens-receiving hole 81 with the ball lens 10 fitted therein is converted into parallel light or converged through the ball lens 10, with the result that the quantity of light incident on the optical sensor 88 at the corresponding position on the inspection jig 87 can exceed a threshold, whereas divergent light leaving the light emitter 82 at the bottom of the ball lens-receiving hole 81 with no ball lens fitted therein is incident as such on the optical sensor 88 at the corresponding position, with the result that the quantity of incident light cannot reach the threshold value (the position of the second ball lens-receiving hole 81 as counted from right in FIG. 19). When the fitted ball lens 10 chips off or it is unacceptable, too, the quantity of light incident on the optical sensor 88 at the corresponding position does never reach the threshold value. In other words, a failure in detection of the quantity of light exceeding such a threshold value even at one of the optical sensors 88 indicates that one or more of the ball lens-receiving holes 81 in the ball lens alignment mold 80 are empty, and so the ball lens alignment mold 80 is rejected as being unacceptable (NG). Once the ball lens alignment mold 80 has been rejected, all the ball lenses are removed therefrom, and the steps of FIGS. 15(*b*) to 15(*d*) are repeated until the ball lens alignment mold 80 is judged as being acceptable by the alignment inspection of FIG. 15(*e*).

In the step of FIG. 15(*e*), it is noted that when the ball lenses 10 are less likely to chip off, it is acceptable to give pass/fail results by monitoring a suction negative pressure of the suction pipe 84 in the ball lens suction mechanism to make a judgment of whether or not the monitored negative pressure value reaches a given value, rather than by carrying out detection of light quantity with such an inspection jig 87 as described above.

Alternatively, a light quantity profile pattern on the surface of the ball lens alignment mold 80 or a surface at a given distance from that surface may be subject to image processing while all the light emitters 82 at the bottoms of the ball lens-receiving holes 81 are allowed to emit light, thereby making a judgment of whether or not the ball lenses 10 are put in order in the step of FIG. 15(*e*).

Further, in place of locating the light emitter 82 at the bottom of each ball lens-receiving hole 81, it is acceptable to form the ball lens alignment mold 80 using a transparent material or form a minute through hole in the center of the bottom of each ball lens-receiving hole 81. In either case, the ball lens alignment mold 80 is illuminated from its back surface with parallel light to make detection of light quantity with the above inspection jig 87 or subject a light quantity profile pattern to image processing for inspection.

Furthermore, it is acceptable to take an image of the ball lens alignment mold 80 from above, so that the image can be subject to image processing, thereby making an inspection of whether or not the given ball lenses 10 are fitted in all the ball lens-receiving holes 81.

Once the lens ball alignment mold has been judged as being acceptable (OK) in the inspection step of FIG. 15(*e*), a group of ball lenses 10 put in order by way of the steps of FIGS. 15(*a*) to 15(*e*) are bonded in steps of FIGS. 16(*a*) to 16(*c*) in such a form that they are transferred as an array-form light source. This is now explained with reference to an embodiment of such an organic EL array 1 as shown in FIG. 4 or 10 used as the array-form light source, wherein the individual ball lenses 10 are bonded in alignment with the individual light emitters 2.

In the step of FIG. 16(*a*), a uniformly thin transparent adhesive layer 13 is coated on the surface of a substrate 3 of an organic EL array 1 that is an array-form light source, including the positions of light emitters 2. Then, the organic EL array 1 is opposed to and in alignment with ball lenses 10 put in order on a ball lens alignment mold 80. In this case, the uniformly thin transparent adhesive layer 13, for instance, may be applied by offset printing. As shown in FIG. 16(*b*), light emitters 2 of the organic EL array and the ball lenses 10 are bright closer together in one-to-one relations until the ball lenses 10 are embedded in the transparent adhesive layer 13. At this time, the transparent adhesive layer 13 is cured. For the adhesive agent in the transparent adhesive layer 13, it is preferable to use an ultraviolet, thermal or other curing type adhesive agent.

Once the transparent adhesive layer 13 has been cured, negative pressures in ball lens-receiving holes 81 in the ball lens alignment mold 80 are cut off to detach the ball lens alignment mold 80 from the organic EL array 1 with the ball lenses 10 bonded thereto, as shown in FIG. 16(*c*), thereby obtaining an organic EL array exposure head wherein the ball lenses 10 are bonded to the light emitters 2 of the organic EL array 1 in one-to-one relations.

It is noted that after the inspection step of FIG. 15(*e*), it is acceptable to apply an adhesive agent on the ball lenses 10 put in order on the ball lens alignment mold 80, and laminate the array-form light source onto the ball lenses 10 in alignment therewith, followed by removal of the ball lens alignment mold 80. It is also acceptable to coat another transparent adhesive layer 13 on the substrate of the array-form light source as shown in FIG. 16(*a*), and laminate the array-form light source onto the ball lenses 10 put in order while they are in alignment with each other, followed by removal of the ball lens alignment mold 80. In either case, for instance, the adhesive agent may be coated on the ball lenses 10 put in order by bringing a group of injectors located in the same pattern as the ball lenses 10 put in order close to the group of ball lenses 10 put in order.

The array-form exposure head may take a form wherein, for instance, ball lenses 10 are bonded and fixed to emitters 2 of an array-form light source 1 in one-to-one relations, as shown in FIG. 16(*c*). Especially in the case of an organic EL array exposure head, however, it is preferable that, as shown in FIG. 10, a fixing layer 14 formed of a black resin or the like is filled between adjacent ball lenses 10 at an area except an effective surface area from which a projection light beam 12 is to emerge, thereby fixing all the ball lenses 10 firmly onto the light emitters 2 of the organic EL array 1 and avoiding noise light such as crosstalk light occurring as a result of a light beam that emerges from a specific light emitter 2 but is incident on an unassociated pixel position via a ball lens 10 adjacent to the associated ball lens 10, and flare light occurring as a result of repeated total reflections of the light beam within the ball lens 10.

Figure 20A:
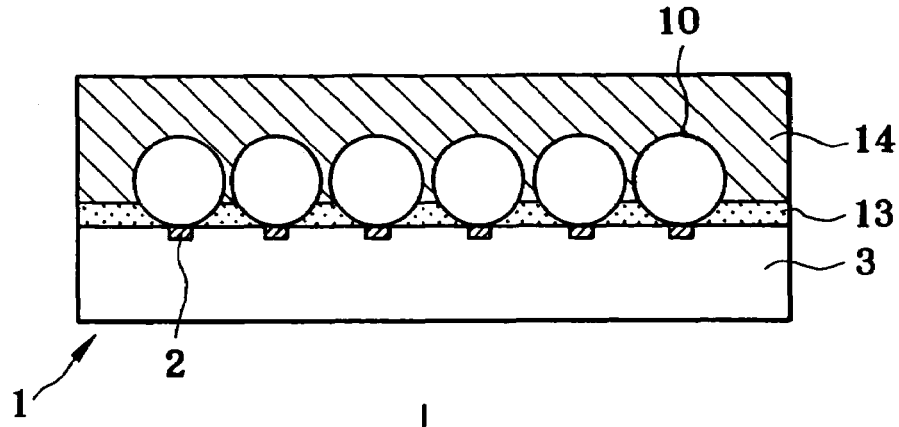
FIGS. 20(*a*) and 20(*b*) are illustrative of one example of how to fill a fixing layer at an area between adjacent lenses except an effective surface.
Figure 20B:
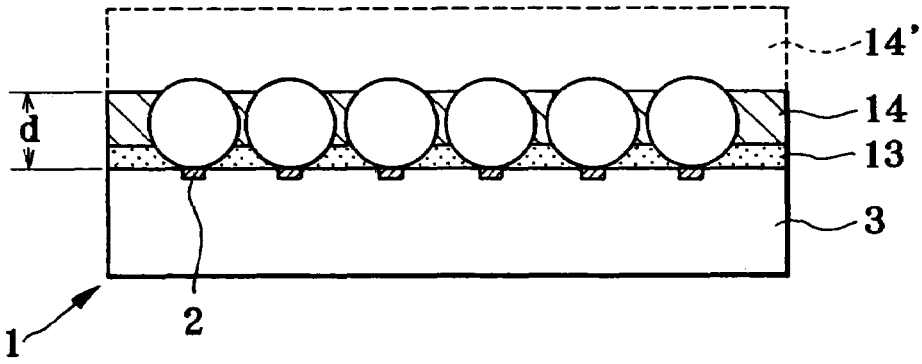

One embodiment of filling the fixing layer 14 formed of a black resin or the like between adjacent ball lenses 10 at an area except an effective surface from which the projection light beam 12 is to emerge is now explained with reference to FIG. 20. As shown in FIG. 20(*a*), a solution of a solvent-soluble resin with a black pigment dispersed therein is cast onto a substrate 3 wherein, in the step of FIG. 16(*c*), the ball lenses 10 are fixed by the transparent adhesive layer 13 to the light emitters 2 of the array-form light source 1 in one-to-one relations to such a thickness that all the ball lenses 10 are embedded therein. Then, the solvent is evaporated off to form the fixing layer 14. Then, as shown in FIG. 20(*b*), the cured fixing layer 14 is immersed in a solvent capable of dissolving it or that solution is coated on the fixing layer 14 to dissolve and remove a constant thickness portion 14' of the fixing layer 14 as viewed from the surface, thereby obtaining such an array-form exposure head.

Figure 21:
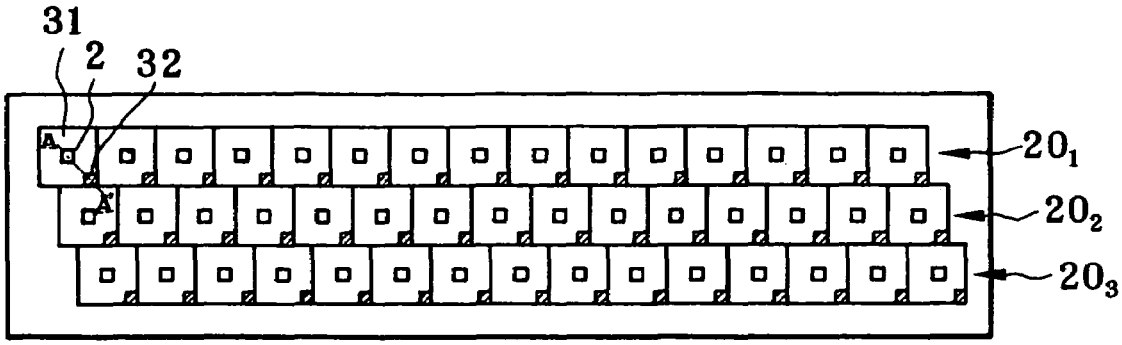
FIG. 21 is a plan view of one array arrangement for the organic EL array.

How to fabricate the organic EL array 1 used in the embodiment of FIG. 4, for instance, is now briefly explained. As shown in FIG. 21, this organic EL array 1 comprises three rows of arrays $\mathbf{20}_1$, $\mathbf{20}_2$ and $\mathbf{20}_3$ arranged parallel with one another, with pixels 31 displaced by a ⅓ pitch. Each array $\mathbf{20}_1$, $\mathbf{20}_2$, $\mathbf{20}_3$ comprises a number of linearly arranged pixels 31, each of the same construction comprising an organic EL light emitter 2 and a TFT 32 for controlling light emitted out of the light emitter 2.

Figure 22:
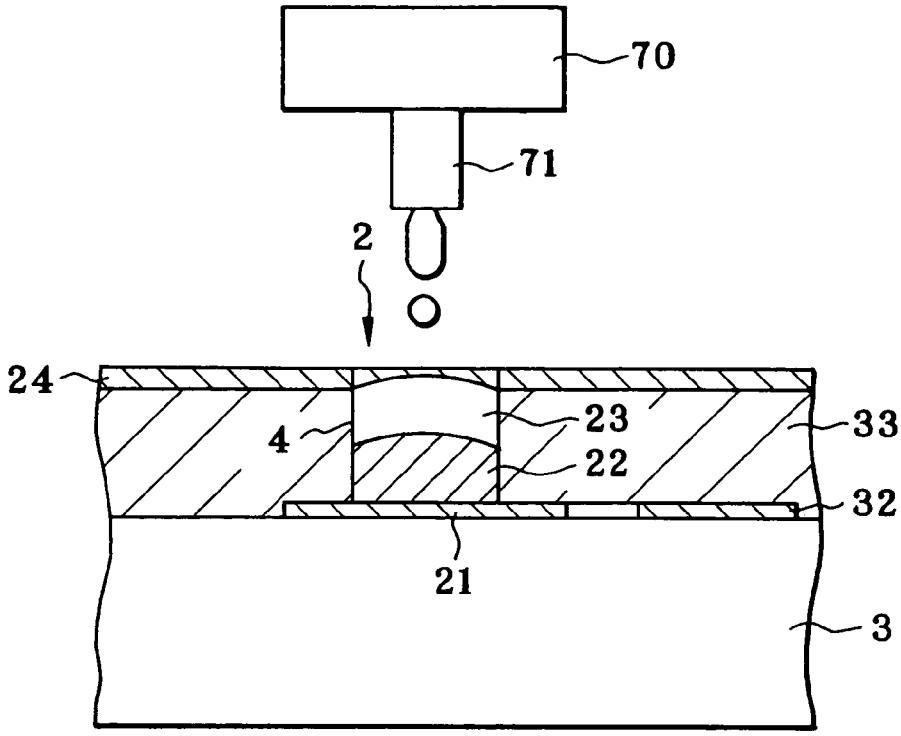
FIG. 22 is a sectional view of one pixel in the array of FIG. 21.

FIG. 22 is a sectional view as taken on line A–A' of FIG. 21, showing an organic EL light emitter 2 and a TFT 32 of one pixel 1. In the organic EL emitter 2, light is emitted out of the cathode side. Electrons and holes injected into the organic EL light emitter 2 from a cathode 24 and an anode 21, respectively, are recombined to emit light; the organic EL light emitter 2 has a structure wherein a light-emitting layer 23 capable of transporting electrons and a hole-injecting layer 22 are stacked together.

FIG. 22 is illustrative in section of the organic EL light emitter 2 and TFT 32 of one pixel 31. With reference to this figure, the order of fabrication is now explained. The TFF 32 is prepared on a glass substrate 3. As well known in the art, the TFT 32 may be prepared in various ways. Typically, a silicon oxide film is first deposited onto the glass substrate 3, followed by deposition of an amorphous silicon film thereon. Then, the amorphous silicon film is crystallized by irradiation with excimer layer light to form a polysilicon film that provides a channel. After patterning of the polysilicon film, a gate insulting film is deposited thereon, followed by formation of a gate electrode comprising tantalum nitride. Subsequently, a source•drain of an N-channel TFT is formed by ion injection of phosphor and a source•drain of a P-channel TFT is formed by ion injection of boron. The ion-doped impurity is activated, sequentially followed by deposition of a first interlayer insulating film, opening of a second contact hole, formation of a source line, deposition of a second interlayer insulating film, opening of a second contact hole and formation of a metal pixel electrode, whereby an array of TFT 32 is completed (cf. non-patent publication 2). It is here noted that the metal pixel electrode forms a part of the anode 21 of the organic EL light emitter 2, which also serves as a reflective layer of the organic EL light emitter 2, and is formed of an Ag, Al or other metal thin film electrode having a high reflectivity. The anode 21 is completed by stacking on the metal thin film electrode an ITO or other transparent electrode thin film having a large work function by vacuum evaporation, sputtering or the like. By forming the upper layer of the anode 21 with an ITO or other transparent electrode thin film having a large work function, it is possible to lower the height of a hole-injecting barrier and, at the same time, effectively use as a reflecting layer the lower metal film layer having a high reflectivity.

Then, a bank 33 having a given height is formed with a hole 4 corresponding to the organic EL light emitter 2. As set forth in patent publication 5, the bank 33 may be prepared by any desired method inclusive of photo-lithography or printing. For instance, when photolithography is used, a coating of an organic material is formed with a bank height by means of given techniques such as spin coating, spray coating, roll coating, die coating or dip coating, followed by application of a resist layer thereon. Then, a mask conforming to the shape of the bank 33 is provided to expose and develop the resist, leaving a resist conforming to the shape of the bank 33. Finally, the bank material is etched to remove a bank material portion other than the mask. Alternatively, the bank (protruding portion) may be comprised of at least two layers wherein the lower layer is formed of an inorganic material and the upper layer is formed of an organic material. As set forth in patent publication 5, the material used to form the bank 33 may be selected from any desired material having sustained resistance to solvents for EL materials; however, it is preferable to employ organic materials such as acryl resins, epoxy resins and photosensitive polyimides because they can be converted into Teflon by fluorocarbon gas plasma treatments. It is also acceptable to make use of a multilayered bank wherein the lower layer is formed of an inorganic material such as liquid glass. The bank 33 should preferably be blackened or opaqued by incorporation of carbon black or the like in the above materials.

Then, the substrate with the bank 33 formed thereon is continuously plasma treated with oxygen gas and fluorocarbon gas plasma just prior to coating of an ink composition for an organic EL light-emitting layer. Thus, for instance, the surface of the polyimide forming the bank 33 is made water-repellent while the surface of the anode 21 is rendered hydrophilic, so that the wettability of the substrate side for fine patterning of ink jet droplets can be controlled. The plasma generator used may be either of the type that generates plasma in vacuum or of the type that generates plasma in the air.

Then, an ink composition for the hole-injecting layer is jetted into a hole 4 in the bank 33 through a head 71 of an ink jet type printer 70 for patterning coating on the anode 21 of each pixel. After coating, the solvent is removed and thermal treatment is carried out to form a hole-injecting layer 22.

Figure 23:
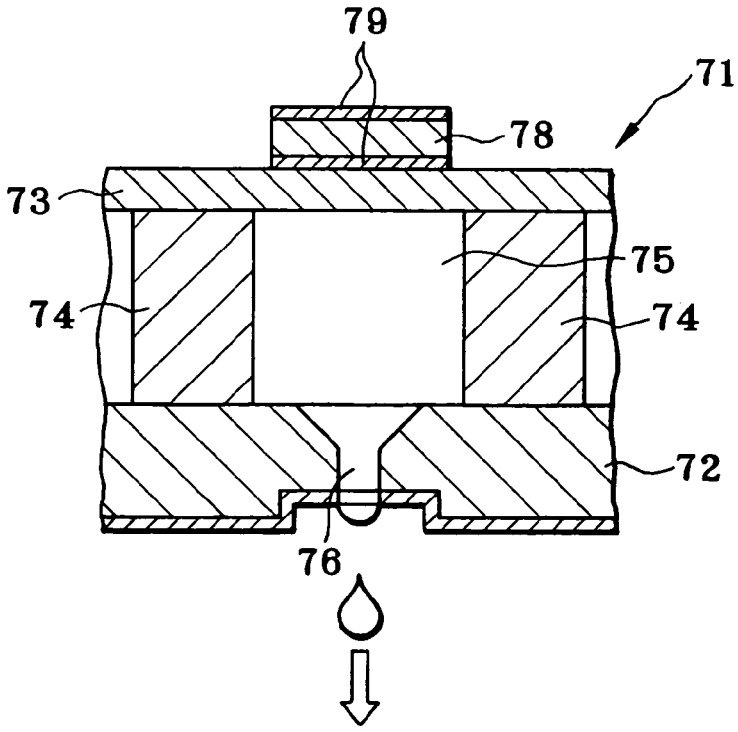
FIG. 23 is illustrative of one exemplary construction of a piezo-jetting head of the ink jet type.

It is here noted that the "ink jet type" referred to herein may be either a piezo-jet type wherein an ink composition is jetted by making use of mechanical energy of a piezoelectric device or the like or a thermal type wherein an ink composition is jetted as a result of formation of air bubbles by thermal energy of a heater (cf. non-patent publication 3). A typical arrangement of a head for the piezo-jet type is shown in FIG. 23. Typically, an ink jetting head 71 comprises a stainless nozzle plate 72 and a vibrator 73 joined together via a partitioning member (reservoir plate) 74. Between the nozzle plate 72 and the vibrator 73, a plurality of ink chambers 75 and liquid reservoirs (not shown) are formed with the partitioning member 74. The ink chambers 75 and liquid reservoirs are filled therein with an ink composition, and the ink chambers 75 are in communication with the liquid reservoirs by way of feed ports. Further, the nozzle plate 75 is provided with a nozzle opening 76 for jetting the ink composition from the ink chamber 75. On the other hand, the ink jetting head 71 is provided with an ink inlet port for feeding the ink composition to the liquid reservoir. A piezoelectric device 78 is joined onto the surface of the vibrator 73 that faces away from the ink chamber 75 at a position corresponding to the position of the ink chamber 75. The piezoelectric device 78, positioned between a pair of electrodes 79, deflects outwardly upon energization, resulting in an increase in the volume of the ink chamber 75. This in turn causes the ink composition in an amount corresponding to the increase in the volume of the ink chamber 75 to flow into the ink chamber 75 from the liquid reservoir by way of the feed port. Upon deenergization of the piezoelectric device 78, the piezoelectric device 78 and vibrator 73 go back to their original shapes. This then causes the space 75 to go back to its original volume, so that the ink composition can be jetted from the nozzle opening 76 toward a substrate with a partition 29 formed thereon through an increase in the pressure of the ink composition within the ink chamber 75.

After a hole-injecting layer 22 is formed on an anode 21 in a hole 4, the ink composition for the light-emitting layer is jetted out of the head 71 of the ink jet printer 70 onto the hole-injecting layer 22 in the hole 4 for patterning coating on the hole-injecting layer 22 of each pixel. After coating, the solvent is removed and thermal treatment is carried out to form a light-emitting layer 23.

It is here noted that the above order of the light-emitting layer 23 and hole-injecting layer 22 may be reversed. Preferably in this case, a layer more resistant to moisture is located on the surface side (that faces away from the substrate 3).

The hole-injecting layer 22 and light-emitting layer 23 may also be prepared by using known techniques such as spine coating, dipping or evaporation in place of the above ink jet technique for coating of ink compositions.

It is also noted that various materials such as those known from patent publications 4 and 5 may be used for the light-emitting layer 23 and hole-injecting layer 22; no details of them are given herein.

After the hole-injecting layer 22 and light-emitting layer 23 have been formed in the hole 4 in the bank 33 in this order, a transparent electrode that provides the cathode 24 of the organic EL light emitter 2 is deposited all over the surface of the substrate by means of sputtering. For the material of this transparent electrode, for instance, use may be made of a calcium or other thin film having a low work function, on which there is additionally provided a gold or other thin film thin enough to transmit light satisfactorily.

In this way, the organic EL array 1 used in the embodiment of FIG. 4 is prepared.

It is noted that it is acceptable to use a thicker bank 33 having a deeper hole 4. In this case, the organic EL light emitter 2 is formed at the bottom of the hole 4, and a transparent material having a protective function or the transparent adhesive agent 13 is overlaid on the organic EL light emitter 2. Then, a ball lens 10 is fitted in the upper portion of that hole 4 so that it can be fixed in alignment with the light emitter 2.

Figure 24A:
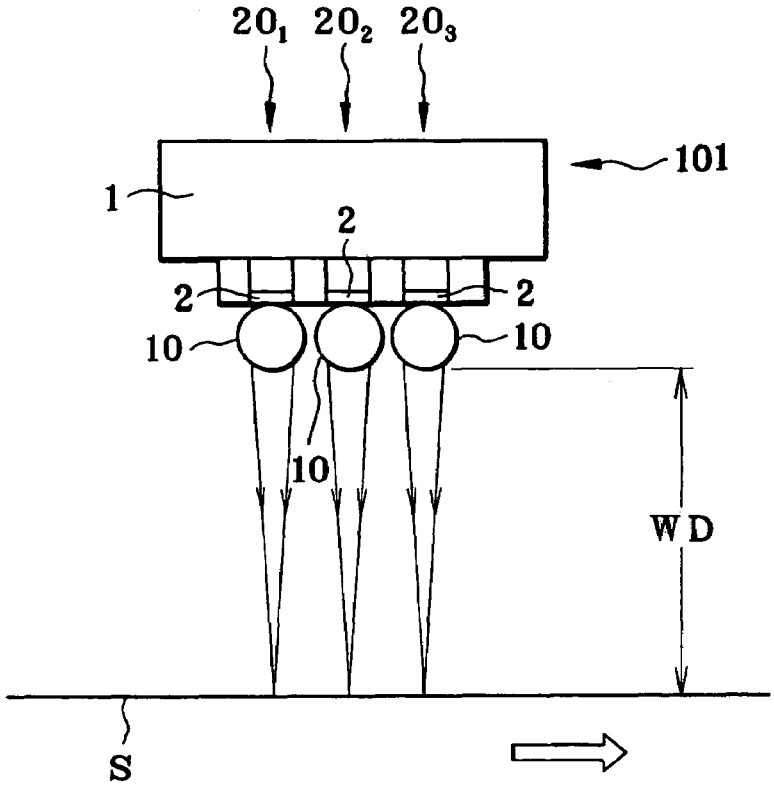
FIGS. 24*a* and 24*b* are side views of how light is collected in the organic EL array exposure head of FIG. 21.
Figure 24B:
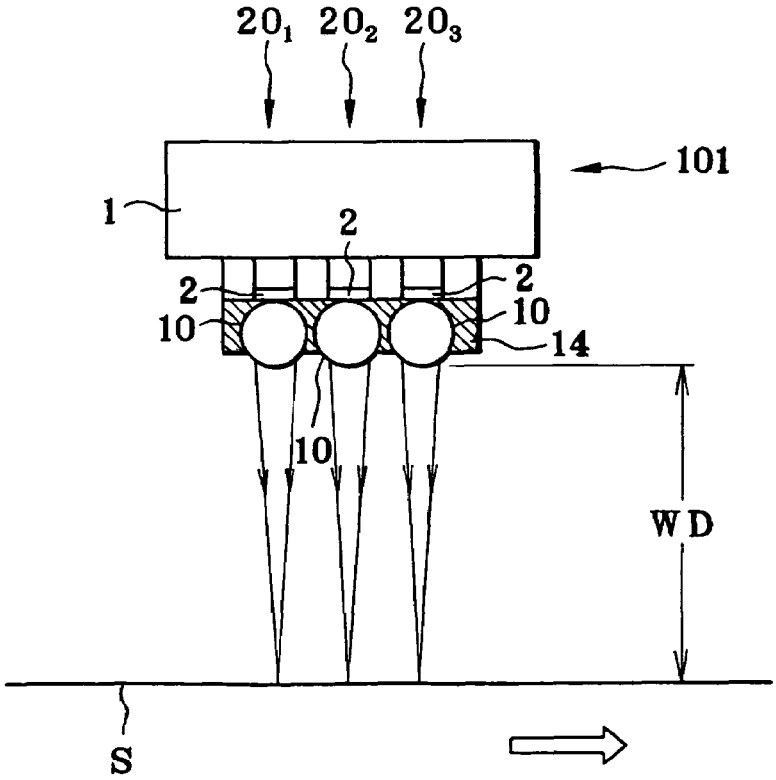

How to use an organic EL array exposure head 101 according to one embodiment of the invention is now explained with reference to FIG. 24 that is a side view. As shown, images 2' of organic EL light emitters 2 are magnified and projected on a surface S spaced at a working distance WD (the distance between the apex of the exit side-surface of a ball lens 10 and an image carrier 11) from the exposure head 101 in the same arrangement pattern as a pixel arrangement thereof. Thus, if the surface S is relatively moved in a direction orthogonal to the longitudinal direction of the exposure head 101 and the light emissions of the organic EL light emitters 2 of the exposure head 101 are controlled by TFTs 33, it is then possible to record a given pattern on the surface S. It is here noted that FIGS. 24(*a*) and 24(*b*) are side views of the first and second organic EL array exposure heads 101 according to the invention, respectively.

Figure 25:
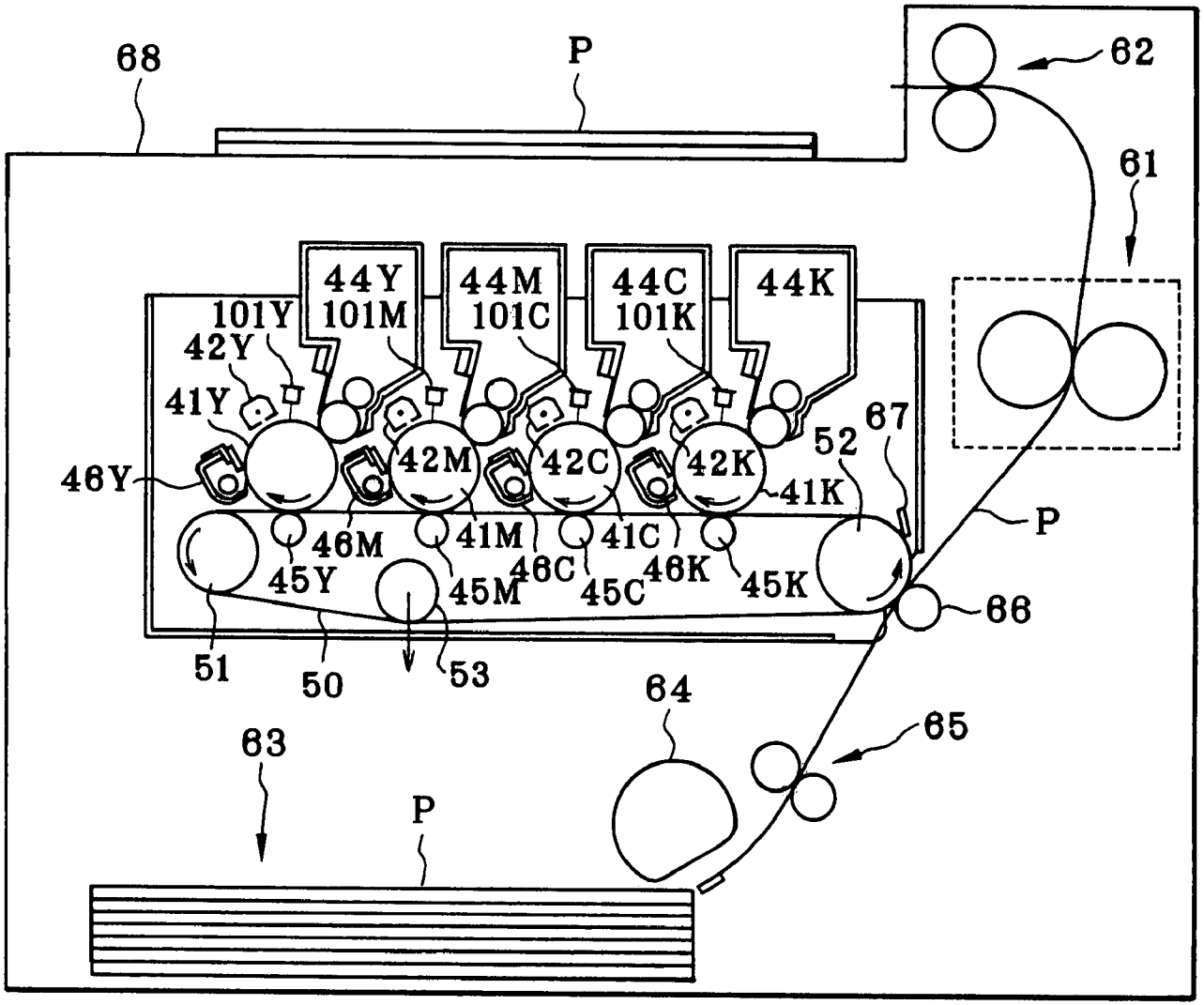
FIG. 25 is a front view schematically illustrative of the whole construction of a tandem type color imaging system incorporating the organic EL array exposure head according to the invention.

Suppose now that such an organic EL array exposure head as mentioned above is used for, e.g., an exposure head of an electrophotographic type color imaging system. FIG. 25 is schematically illustrative in front view of the whole arrangement of a typical tandem type color imaging system wherein four identical organic EL array exposure heads 101K, 101C, 101M and 101Y according to the invention are located at exposure positions of the corresponding four identical photosensitive drums 41K, 41C, 41M and 41Y. In the imaging system of FIG. 25, there is provided an intermediate transfer belt 50 tensioned with a driving roller 51, a follower roller 52 and a tension roller 53 and adapted to be endlessly driven in a direction indicated by an arrow (counterclockwise direction). Four photosensitive members 41K, 41C, 41M and 41Y, each having a photosensitive layer on its outer periphery and serving as an image carrier, are located at a given interval with respect to the intermediate transfer belt 50. The suffixes K, C, M and Y on the reference numerals mean black, cyan, magenta and yellow, respectively, indicating that the photosensitive members are provided for black, cyan, magenta and yellow, respectively. The same holds true for other members. The photosensitive members 41K, 41C, 41M and 41Y are rotated synchronously with the driving of the intermediate transfer roll 50 in a direction indicated by an arrow (clockwise direction). Around each photosensitive member 41 (K, C, M, Y), there are provided a charging means (corona charger) 42 (K, C, M, Y) for uniformly charging the outer surface of the photosensitive member 41 (K, C, M, Y), an organic EL array exposure head 101 (K, C, M, Y), such as one according to the invention, for sequential line scanning of the outer surface uniformly charged by the charging means 42 (K, C, M, Y), which occurs in synchronism with the rotation of the photosensitive member 41 (K, C, M, Y), a developer 44 (K, C, M, Y) for giving a developing agent or a toner to an electrostatic image formed by the organic EL array exposure head 101 (K, C, M, Y) to form a visible (toner) image, a primary transfer roller 45 (K, C, M, Y) acting as a transfer means for sequential transfer of toner images developed by the developer 44 (K, C, M, Y) onto the intermediate transfer belt 50 that is a primary member onto which the toner images are to be transferred, and a cleaner 46 (K, C, M, Y) for removal of a toner portion remaining on the surface of the photosensitive member 41 (K, C, M, Y) after transfer.

Here, each organic EL array exposure head 101 (K, C, M, Y) comprises ball lenses 10 fixed onto organic EL emitters 2 in alignment therewith and in one-to-one relations thereto as shown in FIG. 25, and is located at a working distance WD from the surface of the associated photosensitive member 41 (K, C, M, Y) in such a way that its array direction is along the generating line of the photosensitive member 41 (K, C, M, Y). The emission energy peak wavelength of each organic EL array exposure head 101 (K, C, M, Y) is substantially in coincidence with the sensitivity peak wavelength of the photosensitive member 41 (K, C, M, Y).

For the developer 44 (K, C, M, Y), for instance, nonmagnetic one-component toner is used as the developing agent. The one-component developing agent is carried over, e.g., a feed roller to a developing roller. The thickness of a developing agent film deposited to the surface of the developing roller is controlled by means of a control blade, and the developing roller is brought in contact or engagement with the photosensitive member 41 (K, C, M, Y) to deposit the developing agent onto the photosensitive member 41 (K, C, M, Y) depending on the potential level thereof, so that toner images can be developed.

Black, cyan, magenta and yellow toner images formed at a station for forming four-color toner images for each color are sequentially primarily transferred onto the intermediate transfer roller 50 by means of a primary transfer bias applied to the primary transfer roller 45 (K, C, M, Y), at which they are superposed one upon another on the intermediate transfer belt 50, yielding a full-color toner image. This full-color toner image is secondarily transferred onto a recording medium P such as paper by means of a secondary transfer roller 66, and then passed between a pair of fixing rollers 61 to fix the toner image onto the recording medium P. Finally, the medium P is ejected onto a receiving tray 68 positioned on an upper site of the system by means of a pair of ejection rollers 62.

In FIG. 25, reference numeral 63 stands for a feed cassette containing a stack of recording media P; 64 a pickup roller for feeding the recording media P one by one from the feed cassette 63; 65 a pair of gate rollers for controlling the timing of feeding the recording media P to the secondary transfer section of the secondary transfer roller 66 serving as a secondary transfer means for defining the secondary transfer section relative to the intermediate transfer belt 50; and 67 a cleaning blade severing as a cleaning means for removal of a toner portion remaining on the surface of the intermediate transfer belt 50 after the secondary transfer.

While the present invention has been described with reference to some preferred embodiments of the organic EL array exposure head, the imaging system incorporating the same, and the array-form exposure head fabrication process, it is understood that the invention is not limited to them and so various modifications may be made thereto. For instance, if a transparent conductive film is applied on the surface of the ball lens 10 to keep its surface potential equal to that of photosensitive drum 41 (K, C, M, Y), it is then possible to prevent electrostatic deposition of the developing agent or toner to the surface of the organic EL array exposure head of the invention, especially on the surface of the lens ball 10.

The present invention has favorable advantages over the prior art, as can be understood from the foregoing. According to the first organic EL array exposure head of the invention and the imaging system incorporating the same, an array of organic EL devices are arranged on a long length of substrate in at least one row of pixel pattern, and a ball lens is positioned in alignment with a light emitter of each organic El device on the light-emitting side of the array of organic EL devices, wherein the ball lens is located in such a way as to satisfy condition (8) where D is the distance between the surface of the light-emitting layer in the light emitter of each organic EL device and the apex of the entrance side-surface of the ball lens positioned in alignment with that light emitter and m is the diameter of the ball lens. Thus, nearly all diverging light leaving the light emitter of each organic EL device can be entered in the ball lens so that it can be utilized for pixel formation by projection; images of sufficient resolving power, brightness and contrast can be obtained at low power consumption yet with little or no crosstalk between adjacent pixels.

The third organic EL array exposure head of the invention (incorporated in the imaging system of the invention) comprises a long length of substrate, an array of organic electroluminescent devices arranged on said substrate in at least one row of pixel pattern, and a ball lens positioned in alignment with a light emitter of each organic electroluminescent device on the light-emitting side of the array of organic electroluminescent devices, wherein a space between adjacent ball lenses is filled with a fixing layer up to a height $m(1-1/n^2)$ as measured from the apex of the entrance side-surface of said ball lens, wherein m is the diameter of said ball lens and n is the refractive index of said ball lens, so that said ball lens is fixed in place. Thus, the ball lenses can be firmly fixed onto the substrate with the light emitters located thereon without cutting off a light beam that leaves the light emitter and is projected onto a given surface to form a pixel, thereby obtaining a small-format organic EL array exposure head having sufficient mechanical strength for maintenance operations. By using a layer capable of absorbing light as that fixing layer, it is further possible to achieve an organic EL array exposure head that has reduced crosstalk between adjacent pixels and can give an image of sufficient resolving power, brightness and contrast at low power consumption.

In the fourth organic EL array exposure head of the invention (incorporated in the imaging system of the invention), the ball lens is at least embedded in an aerogel layer from a height $m(1-1/n^2)$ as measured from the apex of the entrance side-surface of said ball lens, where m is the diameter of said ball lens and n is the refractive index of said ball lens, up to a height at which the exit side-surface of said ball lens is overall covered with said aerogel layer. Thus, the ball lenses can be firmly fixed onto the substrate with the light emitters located thereon without cutting off a light beam that leaves the light emitter and is projected onto a given surface to form a pixel, thereby obtaining a small-format organic EL array exposure head having sufficient mechanical strength for maintenance operations. By providing a transparent protective layer, especially a transparent protective layer comprising a transparent conductive layer on the surface of the aerogel layer, it is possible to prevent fouling of the optical system of the organic EL array exposure head with toner or the like, which may otherwise lead to poor exposure or other defects.

In the above array-form exposure head fabrication process of the invention, a ball lens alignment mold is provided with an array of ball-receiving holes in an arrangement conforming to an arrangement of light emitters of said array of light emitting devices or secondary light sources, wherein each ball-receiving hole has a diameter equal to or slightly larger than that of said ball lens, ball lenses are fitted in said ball lens-receiving holes in said ball lens alignment mold, and each ball lens on said ball lens alignment mold is brought close to each light emitter of said array of light-emitting devices or secondary light sources while in alignment therewith, whereupon each ball lens is bonded to said array of light-emitting devices or secondary light sources. It is thus possible to make use of inexpensive, high-refractive-index ball lenses used for reflective paints or the like to fabricate an array-form exposure head such as an LED array exposure head at extremely low costs. In addition, it is possible to achieve an automated optical system alignment/fixation arrangement for high-quality, low-cost array-form exposure heads, thereby fabricating high-quality, low-cost array-form exposure heads.

Further, no large impact is likely to be applied on the ball lenses upon alignment, and so the ball lenses are unlikely to chip off to ensure provision of a high-quality array-form exposure head.

Furthermore, whether alignment is acceptable or unacceptable, and whether or not ball lenses chip off can be 100% inspected at high speed and with high precisions, so that high-quality, low-cost array-form exposure heads can be provided.

The invention claimed is:

1. An organic electroluminescent array exposure head, comprising a long length of substrate, an array of organic electroluminescent devices arranged on said substrate in at least one row of pixel pattern, and a ball lens positioned in alignment with a light emitter of each organic electroluminescent device on a light-emitting side of the array of organic electroluminescent devices, wherein:

a space between adjacent ball lenses is filled with a fixing layer up to a height $m(1-1/n^2)$ as measured from an apex of an entrance side-surface of said ball lens, wherein m is a diameter of said ball lens and n is a refractive index of said ball lens, so that said ball lens is fixed in place.

2. The organic electroluminescent array exposure head according to claim 1, wherein said fixing layer comprises a layer capable of absorbing light.

3. The organic electroluminescent array exposure head according to claim 1, wherein said ball lens has a refractive index of 2 or greater.

4. An imaging system, which incorporates the organic electroluminescent array exposure head according to claim 1 as an exposure head for writing an image to an image carrier.

5. The imaging system according to claim 4, which is a tandem type color imaging system comprising at least two imaging stations, each comprising around the image carrier a charger means, an exposure head, a toner developer means and a transfer means, wherein color imaging is carried out by passing a transfer medium through each station.

6. An organic electroluminescent array exposure head, comprising a long length of substrate, an array of organic electroluminescent devices arranged on said substrate in at least one row of pixel pattern, and a ball lens positioned in alignment with a light emitter of each organic electroluminescent device on a light-emitting side of the array of organic electroluminescent devices, wherein:

said ball lens is at least embedded in an aerogel layer from a height $m(1-1/n^2)$ as measured from an apex of an entrance side-surface of said ball lens, where m is a diameter of said ball lens and n is a refractive index of said ball lens, up to a height at which an exit side-surface of said ball lens is overall covered with said aerogel layer.

7. The organic electroluminescent array exposure head according to claim 6, wherein a transparent protective layer is provided on a surface of said aerogel layer.

8. The organic electroluminescent array exposure head according to claim 7, wherein said transparent protective layer comprises a transparent conductive layer.

9. The organic electroluminescent array exposure head according to any one of claims 6 to 8, wherein a fixing layer capable of absorbing light is provided on a substrate side of said aerogel layer.

* * * * *